US011573039B2

(12) United States Patent
Takegami et al.

(10) Patent No.: US 11,573,039 B2
(45) Date of Patent: Feb. 7, 2023

(54) HEAT SOURCE UNIT AND REFRIGERATION APPARATUS

(71) Applicant: DAIKIN INDUSTRIES, LTD., Osaka (JP)

(72) Inventors: Masaaki Takegami, Osaka (JP); Akitoshi Ueno, Osaka (JP); Shuichi Taguchi, Osaka (JP); Takuya Horita, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/707,421

(22) Filed: Mar. 29, 2022

(65) Prior Publication Data

US 2022/0221208 A1 Jul. 14, 2022

Related U.S. Application Data

(63) Continuation of application No. PCT/JP2020/025228, filed on Jun. 26, 2020.

(30) Foreign Application Priority Data

Sep. 30, 2019 (JP) ..... JP2019-179457

(51) Int. Cl.
*F25B 1/10* (2006.01)
*F25B 49/02* (2006.01)

(52) U.S. Cl.
CPC ..... *F25B 49/02* (2013.01); *F25B 1/10* (2013.01)

(58) Field of Classification Search
CPC ..... F25B 49/02; F25B 49/022; F25B 49/025; F25B 1/10; F25B 41/20; F25B 41/22; F25B 41/24; F25B 41/26; F25B 41/28; F25B 2400/16; F25B 2400/162; F25B 2600/2523; F25B 2700/2108; F25B 43/006
See application file for complete search history.

(56) References Cited

U.S. PATENT DOCUMENTS

2019/0368786 A1* 12/2019 Newel ..... F25B 40/02

FOREIGN PATENT DOCUMENTS

| | | | | |
|---|---|---|---|---|
| CN | 111141076 A | * | 5/2020 | ..... F25B 41/00 |
| EP | 3995758 A1 | * | 5/2022 | |
| JP | 2-217761 A | | 8/1990 | |
| JP | 8-313076 A | | 11/1996 | |
| JP | 2001-280767 A | | 10/2001 | |
| JP | 2003106609 A | * | 4/2003 | |

(Continued)

OTHER PUBLICATIONS

English translation of the International Preliminary Report on Patentability and Written Opinion of the International Searching Authority for International Application No. PCT/JP2020/025228, dated Apr. 14, 2022.

(Continued)

*Primary Examiner* — Miguel A Diaz
(74) *Attorney, Agent, or Firm* — Birch, Stewart, Kolasch & Birch, LLP

(57) ABSTRACT

A heat source controller performs a first operation when a compression element is in a stopped state and a pressure in a receiver exceeds a predetermined first pressure. The heat source controller allows an inlet of the compression element to communicate with the receiver, and drives the compression element in the first operation.

18 Claims, 9 Drawing Sheets

(56) References Cited

FOREIGN PATENT DOCUMENTS

| | | | | | |
|---|---|---|---|---|---|
| JP | 2006-118827 | A | | 5/2006 | |
| JP | 2006162240 | A | * | 6/2006 | |
| JP | 2008-20089 | A | | 1/2008 | |
| JP | 2010-101621 | A | | 5/2010 | |
| JP | 2018-9767 | A | | 1/2018 | |
| JP | 2019-66086 | A | | 4/2019 | |
| WO | WO-2005033593 | A1 | * | 4/2005 | ..... F25B 13/00 |
| WO | WO 2006/115051 | A1 | | 11/2006 | |
| WO | WO-2013125005 | A1 | * | 8/2013 | ..... B60H 1/00392 |
| WO | WO-2015132959 | A1 | * | 9/2015 | ..... F25B 13/00 |
| WO | WO-2022082094 | A1 | * | 4/2022 | |

OTHER PUBLICATIONS

International Search Report (PCT/ISA/210) issued in PCT/JP2020/025228 dated Sep. 8, 2020.
Written Opinion (PCT/ISA/237) issued in PCT/JP2020/025228 dated Sep. 8, 2020.
Extended European Search Report dated Sep. 28, 2022 issued in counterpart European Patent Application No. 20871745.4.

* cited by examiner

HEAT SOURCE UNIT AND REFRIGERATION APPARATUS

CROSS REFERENCE TO RELATED APPLICATIONS

This application is a Continuation of PCT International Application No. PCT/JP2020/025228, filed on Jun. 26, 2020, which claims priority under 35 U.S.C. 119(a) to Patent Application No. 2019-179457, filed in Japan on Sep. 30, 2019, all of which are hereby expressly incorporated by reference into the present application.

TECHNICAL FIELD

The present disclosure relates to a heat source unit and a refrigeration apparatus.

BACKGROUND ART

Patent Document 1 discloses a refrigeration apparatus including a heat-source-side unit and a utilization-side unit. The heat-source-side unit includes a compressor, a heat-source-side heat exchanger, and a receiver. The receiver stores a high-pressure liquid refrigerant during a cooling operation.

CITATION LIST

Patent Document

Patent Document 1: Japanese Unexamined Patent Publication No. 2019-66086

SUMMARY

A first aspect of the present disclosure relates to a heat source unit of a refrigeration apparatus (1). The heat source unit includes: a heat source circuit (11) having a compression element (20), a heat source heat exchanger (40), and a receiver (41); and a heat source controller (14) configured to perform a first operation when the compression element (20) is in a stopped state and a pressure (RP) in the receiver (41) exceeds a predetermined first pressure (Pth1), wherein the heat source controller (14) allows an inlet of the compression element (20) to communicate with the receiver (41), and drives the compression element (20) in the first operation.

DESCRIPTION OF EMBODIMENTS

Figure 1:
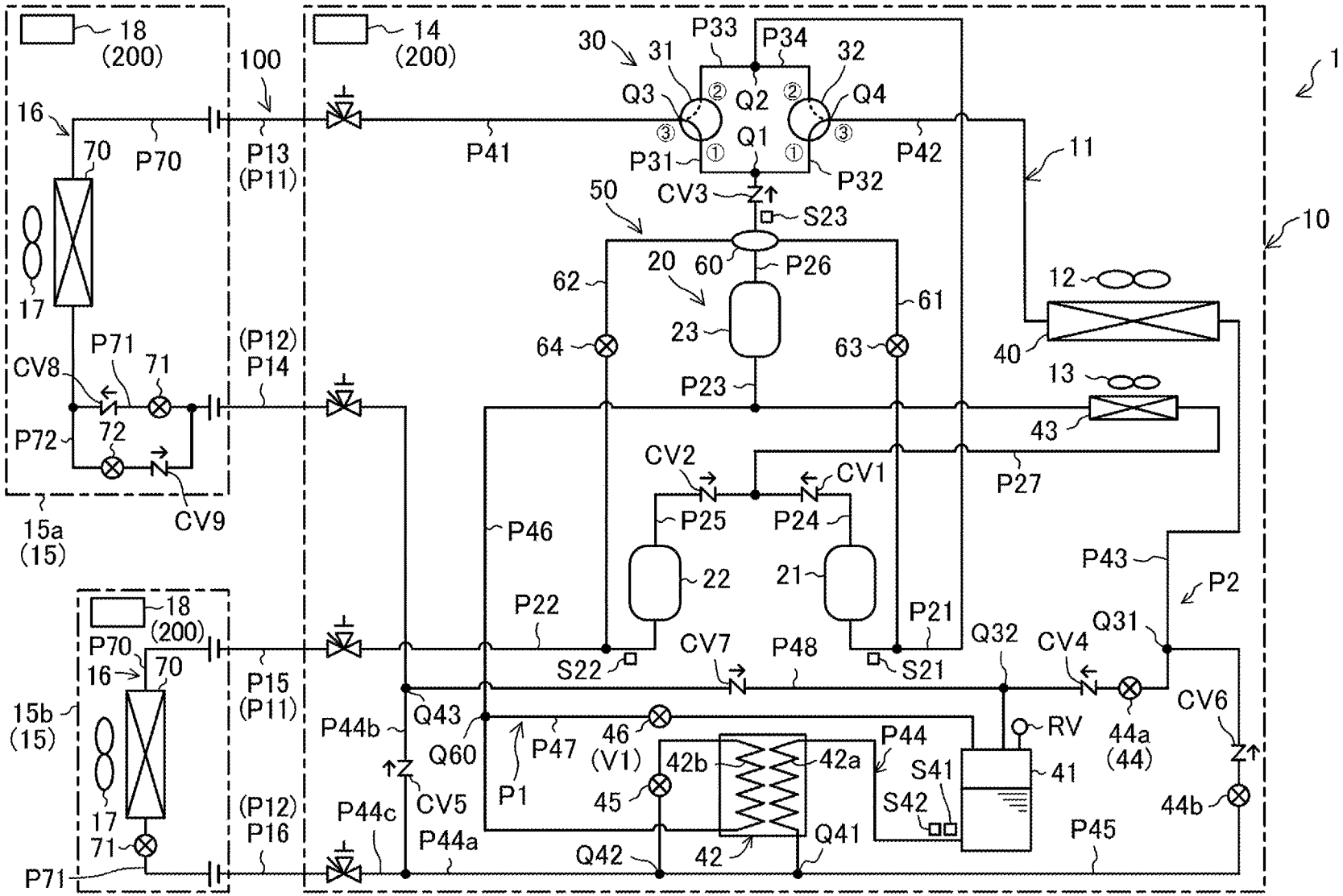
FIG. 1 is a piping system diagram illustrating a configuration of a refrigeration apparatus according to an embodiment.

Embodiments will be described in detail with reference to the drawings. Note that like reference characters denote the same or equivalent components in the drawings, and the description thereof will not be repeated.

(Refrigeration Apparatus)

FIG. 1 illustrates a configuration of a refrigeration apparatus (1) according to an embodiment. The refrigeration apparatus (1) includes a heat source unit (10) and one or more utilization units (15). The heat source unit (10) and the one or more utilization units (15) are connected by a gas connection pipe (P11) and a liquid connection pipe (P12) to form a refrigerant circuit (100).

In this example, the refrigeration apparatus (1) cools the interior of a refrigeration facility such as a refrigerator, a freezer, and a showcase (will be hereinafter referred to as "cold storage"), and conditions the air in a room. Specifically, the refrigeration apparatus (1) includes two utilization units (15). One of the two utilization units (15) constitutes an indoor unit (15*a*) provided indoors, and the other constitutes a cold storage unit (15*b*) provided for the cold storage. In this example, the heat source unit (10) is placed outdoors. The refrigeration apparatus (1) is provided with a first gas connection pipe (P13) and a first liquid connection pipe (P14) corresponding to the indoor unit (15*a*), and a second gas connection pipe (P15) and a second liquid connection pipe (P16) corresponding to the cold storage unit (15*b*). The heat source unit (10) and the indoor unit (15*a*) are connected by the first gas connection pipe (P13) and the first liquid connection pipe (P14), and the heat source unit (10) and the cold storage unit (15*b*) are connected by the second gas connection pipe (P15) and the second liquid connection pipe (P16), thereby forming the refrigerant circuit (100).

A refrigerant circulates in the refrigerant circuit (100) to perform a refrigeration cycle. In this example, the refrigerant filling the refrigerant circuit (100) is carbon dioxide. The refrigerant circuit (100) is configured to perform a refrigeration cycle in which the pressure of the refrigerant is equal to or greater than a critical pressure.

[Heat Source Unit and Utilization Unit]

The heat source unit (10) includes a heat source circuit (11), a heat source fan (12), a cooling fan (13), and a heat source controller (14). The utilization unit (15) includes a utilization circuit (16), a utilization fan (17), and a utilization controller (18). The gas connection pipe (P11) connects a gas end of the heat source circuit (11) and a gas end of the utilization circuit (16), and the liquid connection pipe (P12) connects a liquid end of the heat source circuit (11) and a liquid end of the utilization circuit (16). Thus, the refrigerant circuit (100) is formed.

In this example, the first gas connection pipe (P13) connects the gas end of the heat source circuit (11) and the gas end of the utilization circuit (16) of the indoor unit (15*a*), and the first liquid connection pipe (P14) connects the liquid end of the heat source circuit (11) and the liquid end of the utilization circuit (16) of the indoor unit (15*a*). The second gas connection pipe (P15) connects the gas end of the heat source circuit (11) and the gas end of the utilization circuit (16) of the cold storage unit (15*b*), and the second liquid connection pipe (P16) connects the liquid end of the heat source circuit (11) and the liquid end of the utilization circuit (16) of the cold storage unit (15*b*).

[Heat Source Circuit]

The heat source circuit (11) includes a compression element (20), a switching unit (30), a heat source heat exchanger (40), a receiver (41), a cooling heat exchanger (42), an intercooler (43), a first heat source expansion valve (44*a*), a second heat source expansion valve (44*b*), a cooling expansion valve (45), a venting valve (46), and a pressure release valve (RV). The heat source circuit (11) is provided with first to eighth heat source passages (P41 to P48). For example, the first to eighth heat source passages (P41 to P48) are formed by refrigerant pipes.

<Compression Element>

The compression element (20) sucks the refrigerant, compresses the sucked refrigerant, and discharges the compressed refrigerant. In this example, the compression element (20) includes a plurality of compressors. Specifically, the compression element (20) includes a first compressor (21), a second compressor (22), and a third compressor (23). In this example, the compression element (20) is a two-stage compression element. The first compressor (21) and the second compressor (22) are low-stage compressors, and the third compressor (23) is a high-stage compressor. The first compressor (21) corresponds to the indoor unit (15*a*), and the second compressor (22) corresponds to the cold storage unit (15*b*).

The first compressor (21) has a suction port and a discharge port. The first compressor (21) sucks the refrigerant through the suction port to compress the refrigerant, and discharges the compressed refrigerant through the discharge port. In this example, the first compressor (21) is a rotary compressor including an electric motor and a compression mechanism rotationally driven by the electric motor. For example, the first compressor (21) is a scroll compressor. The first compressor (21) is a variable capacity compressor whose number of rotations (operation frequency) is adjustable.

The second compressor (22) and the third compressor (23) are configured in the same manner as the first compressor (21). In this example, the suction port of each of the first compressor (21), the second compressor (22), and the third compressor (23) constitutes an inlet of the compression element (20), and the discharge port of the third compressor (23) constitutes an outlet of the compression element (20).

Further, in this example, the compression element (20) has first to third suction passages (P21 to P23), first to third discharge passages (P24 to P26), and an intermediate passage (P27). For example, these passages (P21 to P27) are formed by refrigerant pipes. Each of the first to third suction passages (P21 to P23) has one end connected to the suction port of the corresponding one of the first to third compressors (21 to 23). The other end of the first suction passage (P21) is connected to a second port (Q2) of the switching unit (30). The other end of the second suction passage (P22) is connected to one end of the second gas connection pipe (P15). One end of each of the first to third discharge passages (P24 to P26) is connected to the discharge port of the corresponding one of the first to third compressors (21 to 23). The other end of the third discharge passage (P26) is connected to a first port (Q1) of the switching unit (30). One end of the intermediate passage (P27) is connected to the other end of the first discharge passage (P24) and the other end of the second discharge passage (P25), and the other end of the intermediate passage (P27) is connected to the other end of the third suction passage (P23).

<Switching Unit>

The switching unit (30) has a first port (Q1), a second port (Q2), a third port (Q3), and a fourth port (Q4), and switches the state of communication among the first to fourth ports (Q1 to Q4). The first port (Q1) is connected to the discharge port of the third compressor (23), which is the outlet of the compression element (20), by the third discharge passage (P26). The second port (Q2) is connected to the suction port of the first compressor (21) by the first suction passage (P21). The third port (Q3) is connected to one end of a first heat source passage (P41), and the other end of the first heat source passage (P41) is connected to one end of the first gas connection pipe (P13). The fourth port (Q4) is connected to one end of a second heat source passage (P42), and the other end of the second heat source passage (P42) is connected to the gas end of the heat source heat exchanger (40).

In this example, the switching unit (30) includes a first three-way valve (31) and a second three-way valve (32). The switching unit (30) also includes first to fourth switching passages (P31 to P34). The first to fourth switching passages (P31 to P34) are formed by, for example, refrigerant pipes. The first three-way valve (31) has first to third ports, and is switched between a first communication state (a state indicated by a solid curve in FIG. 1) in which the first and third ports communicate with each other, and a second communication state (a state indicated by a broken curve in FIG. 1) in which the second and third ports communicate with each other. The second three-way valve (32) is configured in the same manner as the first three-way valve (31).

The first switching passage (P31) connects the first port of the first three-way valve (31) and the other end of the third discharge passage (P26). The second switching passage (P32) connects the first port of the second three-way valve (32) and the other end of the third discharge passage (P26). The third switching passage (P33) connects the second port of the first three-way valve (31) and the other end of the first suction passage (P21). The fourth switching passage (P34) connects the second port of the second three-way valve (32) and the other end of the first suction passage (P21). The third port of the first three-way valve (31) is connected to one end of the first gas connection pipe (P13) by the first heat source passage (P41). The third port of the second three-way valve (32) is connected to the gas end of the heat source heat exchanger (40) by the second heat source passage (P42).

In this example, a junction of the first switching passage (P31), the second switching passage (P32), and the third discharge passage (P26) constitutes the first port (Q1), and a junction of the third switching passage (P33), the fourth switching passage (P34), and the first suction passage (P21) constitutes the second port (Q2). The third port of the first three-way valve (31) constitutes the third port (Q3), and the third port of the second three-way valve (32) constitutes the fourth port (Q4).

<Heat Source Fan and Heat Source Heat Exchanger>

The heat source fan (12) is arranged near the heat source heat exchanger (40) and conveys the air (outdoor air in this example) to the heat source heat exchanger (40). The heat source heat exchanger (40) exchanges heat between the refrigerant flowing through the heat source heat exchanger (40) and the air conveyed by the heat source fan (12) to the heat source heat exchanger (40). For example, the heat source heat exchanger (40) is a fin-and-tube heat exchanger.

In this example, the gas end of the heat source heat exchanger (40) is connected to the fourth port (Q4) of the switching unit (30) by the second heat source passage (P42). The liquid end of the heat source heat exchanger (40) is connected to one end of the third heat source passage (P43), and the other end of the third heat source passage (P43) is connected to the inlet of the receiver (41).

<Receiver>

The receiver (41) stores the refrigerant and separates the refrigerant into a gas refrigerant and a liquid refrigerant. For example, the receiver (41) is constituted of a pressure vessel. The receiver (41) is configured to be heatproof. For example, a heat insulating layer made of a heat insulating material is provided on a peripheral wall of the receiver (41).

In this example, the inlet of the receiver (41) is connected to the liquid end of the heat source heat exchanger (40) by the third heat source passage (P43). A liquid outlet of the receiver (41) is connected to one end of the liquid connection pipe (P12) by the fourth heat source passage (P44). Specifically, the fourth heat source passage (P44) includes a main passage (P44*a*), a first branch passage (P44*b*), and a second branch passage (P44*c*). One end of the main passage (P44*a*) is connected to the liquid outlet of the receiver (41). One end of the first branch passage (P44*b*) is connected to the other end of the main passage (P44*a*), and the other end of the first branch passage (P44*b*) is connected to one end of the first liquid connection pipe (P14). One end of the second branch passage (P44*c*) is connected to the other end of the main passage (P44*a*), and the other end of the second branch passage (P44*c*) is connected to one end of the second liquid connection pipe (P16).

In this example, one end of the fifth heat source passage (P45) is connected to a first intermediate portion (Q41) of the fourth heat source passage (P44), and the other end of the fifth heat source passage (P45) is connected to a first intermediate portion (Q31) of the third heat source passage (P43). One end of the sixth heat source passage (P46) is connected to a second intermediate portion (Q42) of the fourth heat source passage (P44), and the other end of the sixth heat source passage (P46) is connected to the other end of the third suction passage (P23). One end of the seventh heat source passage (P47) is connected to a gas outlet of the receiver (41), and the other end of the seventh heat source passage (P47) is connected to an intermediate portion (Q60) of the sixth heat source passage (P46). One end of the eighth heat source passage (P48) is connected to a second intermediate portion (Q32) of the third heat source passage (P43), and the other end of the eighth heat source passage (P48) is connected to a third intermediate portion (Q43) of the fourth heat source passage (P44).

The second intermediate portion (Q32) of the third heat source passage (P43) is located in the third heat source passage (P43) between the first intermediate portion (Q31) and the receiver (41). In the fourth heat source passage (P44), the first intermediate portion (Q41), the second intermediate portion (Q42), and the third intermediate portion (Q43) are arranged in this order from the liquid outlet of the receiver (41) toward one end of the liquid connection pipe (P12). Specifically, the first intermediate portion (Q41) of the fourth heat source passage (P44) is located in the main passage (P44*a*) of the fourth heat source passage (P44). The second intermediate portion (Q42) of the fourth heat source passage (P44) is located in the main passage (P44*a*) of the fourth heat source passage (P44) between the first intermediate portion (Q41) and the other end of the main passage (P44*a*), i.e., a junction of the main passage (P44*a*), the first branch passage (P44*b*), and the second branch passage (P44*c*). The third intermediate portion (Q43) of the fourth heat source passage (P44) is located in the first branch passage (P44*b*) of the fourth heat source passage (P44).

<Heat Source Passage>

In this example, the first heat source passage (P41) is a passage provided for communication between the outlet of the compression element (20) and the gas end of the utilization circuit (16) of the indoor unit (15*a*). The second heat source passage (P42) is a passage provided for communication between the outlet of the compression element (20) and the gas end of the heat source heat exchanger (40). The third heat source passage (P43) is a passage provided for communication between the liquid end of the heat source heat exchanger (40) and the inlet of the receiver (41). The fourth heat source passage (P44) is a passage provided for communication between the liquid outlet of the receiver (41) and the liquid ends of the utilization circuits (16) of the indoor unit (15*a*) and the cold storage unit (15*b*). The fifth heat source passage (P45) is a passage provided for communication between the liquid outlet of the receiver (41) and the liquid end of the heat source heat exchanger (40). The sixth heat source passage (P46) is a passage (injection passage) provided to supply part of the refrigerant flowing through the fourth heat source passage (P44) to the inlet of the compression element (20) (the suction port of the third compressor (23) in this example). The seventh heat source passage (P47) is a passage (venting passage) provided to discharge the gas refrigerant collected in the receiver (41) from the receiver (41). The eighth heat source passage (P48) is a passage provided for communication between the liquid end of the utilization circuit (16) of the indoor unit (15*a*) and the inlet of the receiver (41).

<Cooling Heat Exchanger>

The cooling heat exchanger (42) is connected to the fourth heat source passage (P44) and the sixth heat source passage (P46), and exchanges heat between the refrigerant flowing through the fourth heat source passage (P44) and the refrigerant flowing through the sixth heat source passage (P46). In this example, the cooling heat exchanger (42) includes a first refrigerant passage (42*a*) incorporated in the fourth heat source passage (P44) and a second refrigerant passage (42*b*) incorporated in the sixth heat source passage (P46), and exchanges heat between the refrigerant flowing through the first refrigerant passage (42*a*) and the refrigerant flowing through the second refrigerant passage (42*b*). Specifically, the first refrigerant passage (42*a*) is arranged in the fourth heat source passage (P44) between the receiver (41) and the first intermediate portion (Q41). The second refrigerant passage (42*b*) is arranged in the sixth heat source passage (P46) between one end of the sixth heat source passage (P46) (the second intermediate portion (Q42) of the fourth heat source passage (P44)) and the intermediate portion (Q60). For example, the cooling heat exchanger (42) is a plate heat exchanger.

<Cooling Fan and Intercooler>

The cooling fan (13) is arranged near the intercooler (43) and conveys the air (outdoor air in this example) to the intercooler (43). The intercooler (43) is provided in the intermediate passage (P27), and exchanges heat between the refrigerant flowing through the intermediate passage (P27) and the air conveyed by the cooling fan (13) to the intercooler (43). Thus, the refrigerant flowing through the intermediate passage (P27) is cooled. For example, the intercooler (43) is a fin-and-tube heat exchanger.

<First Heat Source Expansion Valve>

The first heat source expansion valve (44*a*) is provided in the third heat source passage (P43), and decompresses the refrigerant. In this example, the first heat source expansion valve (44*a*) is arranged in the third heat source passage (P43) between the first intermediate portion (Q31) and the second intermediate portion (Q32). The first heat source expansion valve (44*a*) has a variable opening degree. For example, the first heat source expansion valve (44*a*) is an electronic expansion valve (motor-operated valve).

<Second Heat Source Expansion Valve>

The second heat source expansion valve (44*b*) is provided in the fifth heat source passage (P45), and decompresses the refrigerant. The second heat source expansion valve (44*b*) has a variable opening degree. For example, the second heat source expansion valve (44*b*) is an electronic expansion valve (motor-operated valve).

<Cooling Expansion Valve>

The cooling expansion valve (45) is provided in the sixth heat source passage (P46), and decompresses the refrigerant. In this example, the cooling expansion valve (45) is arranged in the sixth heat source passage (P46) between one end of the sixth heat source passage (P46) (the second intermediate portion (Q42) of the fourth heat source passage (P44)) and the cooling heat exchanger (42). The cooling expansion valve (45) has a variable opening degree. For example, the cooling expansion valve (45) is an electronic expansion valve (motor-operated valve).

<Venting Valve>

The venting valve (46) is provided in the seventh heat source passage (P47). The venting valve (46) has a variable opening degree. For example, venting valve (46) is a motor-operated valve. The venting valve (46) may be an on-off valve (electromagnetic valve) that is switchable between an open state and a closed state.

<Pressure Release Valve>

The pressure release valve (RV) is operated when the pressure (RP) in the receiver (41) exceeds a predetermined operating pressure. In this example, the pressure release valve (RV) is provided for the receiver (41). When the pressure release valve (RV) is operated, the refrigerant in the receiver (41) is discharged from the receiver (41) through the pressure release valve (RV).

<Check Valve>

The heat source circuit (11) is provided with first to seventh check valves (CV1 to CV7). The first check valve (CV1) is provided in the first discharge passage (P24). The second check valve (CV2) is provided in the second discharge passage (P25). The third check valve (CV3) is provided in the third discharge passage (P26). The fourth check valve (CV4) is provided for the third heat source passage (P43), and is arranged in the third heat source passage (P43) between the first heat source expansion valve (44*a*) and the second intermediate portion (Q32). The fifth check valve (CV5) is provided in the fourth heat source passage (P44), and is arranged in the first branch passage (P44*b*) of the fourth heat source passage (P44) between the third intermediate portion (Q43) and a junction of the main passage (P44*a*), the first branch passage (P44*b*), and the second branch passage (P44*c*). The sixth check valve (CV6) is provided in the fifth heat source passage (P45), and is arranged in the fifth heat source passage (P45) between one end of the fifth heat source passage (P45) (the first intermediate portion (Q31) of the fourth heat source passage (P44)) and the second heat source expansion valve (44*b*). The seventh check valve (CV7) is provided in the eighth heat source passage (P48). Each of the first to seventh check valves (CV1 to CV7) allows the refrigerant to flow in the direction of the arrows shown in FIG. 1 and prohibits the refrigerant to flow in the opposite direction.

<Oil Separation Circuit>

The heat source circuit (11) is provided with an oil separation circuit (50). The oil separation circuit (50) includes an oil separator (60), a first oil return pipe (61), a second oil return pipe (62), a first oil control valve (63), and a second oil control valve (64). The oil separator (60) is provided in the third discharge passage (P26), and separates oil from the refrigerant discharged from the compression element (20), i.e., the third compressor (23). One end of the first oil return pipe (61) is connected to the oil separator (60), and the other end of the first oil return pipe (61) is connected to the first suction passage (P21). One end of the second oil return pipe (62) is connected to the oil separator (60), and the other end of the second oil return pipe (62) is connected to the second suction passage (P22). The first oil control valve (63) is provided in the first oil return pipe (61), and the second oil control valve (64) is provided in the second oil return pipe (62).

With this configuration, part of the oil collected in the oil separator (60) returns to the first compressor (21) through the first oil return pipe (61) and the first suction passage (P21), and the remainder returns to the second compressor (22) through the second oil return pipe (62) and the second suction passage (P22). The oil collected in the oil separator (60) may return to the third compressor (23). Alternatively, the oil collected in the oil separator (60) may directly return to an oil reservoir (not shown) in the casing of the first compressor (21), an oil reservoir (not shown) in the casing of the second compressor (22), or an oil reservoir (not shown) in the casing of the third compressor (23).

[Various Sensors in Heat Source Unit]

The heat source unit (10) is provided with various sensors, such as a pressure sensor and a temperature sensor. The various sensors detect physical quantities, such as the pressure and temperature of a high-pressure refrigerant in the refrigerant circuit (100), the pressure and temperature of a low-pressure refrigerant in the refrigerant circuit (100), the pressure and temperature of an intermediate-pressure refrigerant in the refrigerant circuit (100), the pressure and temperature of a refrigerant in the heat source heat exchanger (40), and the temperature of the air (outdoor air in this example) sucked into the heat source unit (10).

In this example, the heat source unit (10) is provided with a receiver pressure sensor (S41), a receiver temperature sensor (S42), a first suction pressure sensor (S21), a second suction pressure sensor (S22), and a discharge pressure sensor (S23). The receiver pressure sensor (S41) detects the pressure in the receiver (41) (i.e., the pressure of the refrigerant). The receiver temperature sensor (S42) detects the temperature in the receiver (41) (i.e., the temperature of the refrigerant). The first suction pressure sensor (S21) detects the pressure of the refrigerant on the suction side of the first compressor (21) (an example of the suction side of the compression element (20)). The second suction pressure sensor (S22) detects the pressure of the refrigerant on the suction side of the second compressor (22) (an example of the suction side of the compression element (20)). The discharge pressure sensor (S23) detects the pressure of the refrigerant on the discharge side of the third compressor (23) (an example of the discharge side of the compression element (20)).

[Heat Source Controller]

The heat source controller (14) is connected to the various sensors (i.e., the receiver pressure sensor (S41), the receiver temperature sensor (S42), the first suction pressure sensor (S21), the second suction pressure sensor (S22), the discharge pressure sensor (S23), etc.) provided in the heat source unit (10) via communication lines. The heat source controller (14) is connected to the components of the heat source unit (10) (i.e., the compression element (20), the switching unit (30), the first heat source expansion valve (44*a*), the second heat source expansion valve (44*b*), the cooling expansion valve (45), the venting valve (46), the heat source fan (12), the cooling fan (13), etc.), via communication lines. The heat source controller (14) controls the components of the heat source unit (10) based on detection signals of the various sensors provided in the heat source unit (10) (signals indicating detection results of the various sensors) and external signals (e.g., operation commands). For example, the heat source controller (14) includes a processor and a memory that stores programs and information for operating the processor.

[Utilization Circuit]

The utilization circuit (16) includes a utilization heat exchanger (70) and a utilization expansion valve (71). The utilization circuit (16) also includes a utilization gas passage (P70) and a utilization liquid passage (P71). The utilization gas passage (P70) and the utilization liquid passage (P71) are formed by, for example, refrigerant pipes.

In this example, the utilization circuit (16) of the utilization unit (15) constituting the indoor unit (15*a*) includes, in addition to the utilization heat exchanger (70) and the utilization expansion valve (71), an auxiliary expansion valve (72), an eighth check valve (CV8), and a ninth check valve (CV9). The utilization circuit (16) of the utilization unit (15) constituting the indoor unit (15*a*) further includes an auxiliary passage (P72) in addition to the utilization gas passage (P70) and the utilization liquid passage (P71).

<Utilization Fan and Utilization Heat Exchanger>

The utilization fan (17) is arranged near the utilization heat exchanger (70) and conveys the air (room air or air inside the cold storage in this example) to the utilization heat exchanger (70). The utilization heat exchanger (70) exchanges heat between the refrigerant flowing through the utilization heat exchanger (70) and the air conveyed by the utilization fan (17) to the utilization heat exchanger (70). For example, the utilization heat exchanger (70) is a fin-and-tube heat exchanger.

In this example, a gas end of the utilization heat exchanger (70) is connected to one end of the utilization gas passage (P70), and the other end of the utilization gas passage (P70) is connected to the other end of the gas connection pipe (P11). Specifically, the other end of the utilization gas passage (P70) of the utilization circuit (16) of the indoor unit (15*a*) is connected to the other end of the first gas connection pipe (P13), and the other end of the utilization gas passage (P70) of the utilization circuit (16) of the cold storage unit (15*b*) is connected to the other end of the second gas connection pipe (P15). The liquid end of the utilization heat exchanger (70) is connected to one end of the utilization liquid passage (P71), and the other end of the utilization liquid passage (P71) is connected to the other end of the liquid connection pipe (P12). Specifically, the other end of the utilization liquid passage (P71) of the utilization circuit (16) of the indoor unit (15*a*) is connected to the other end of the first liquid connection pipe (P14), and the other end of the utilization liquid passage (P71) of the utilization circuit (16) of the cold storage unit (15*b*) is connected to the other end of the second liquid connection pipe (P16).

<Utilization Expansion Valve>

The utilization expansion valve (71) is provided in the utilization liquid passage (P71), and decompresses the refrigerant. The utilization expansion valve (71) has a variable opening degree. For example, the utilization expansion valve (71) is an electronic expansion valve (motor-operated valve).

<Auxiliary Expansion Valve>

The auxiliary expansion valve (72) is provided in the auxiliary passage (P72), and decompresses the refrigerant. The auxiliary expansion valve (72) has a variable opening degree. For example, the auxiliary expansion valve (72) is an electronic expansion valve (motor-operated valve).

In this example, in the utilization circuit (16) of the indoor unit (15*a*), one end of the auxiliary passage (P72) is connected to the liquid end of the utilization heat exchanger (70), and the other end of the auxiliary passage (P72) is connected to the other end of the first liquid connection pipe (P14).

<Check Valve>

In the utilization circuit (16) of the indoor unit (15*a*), the eighth check valve (CV8) is provided in the utilization liquid passage (P71), and is arranged in the utilization liquid passage (P71) between the liquid end of the heat source heat exchanger (40) and the utilization expansion valve (71). The ninth check valve (CV9) is provided in the auxiliary passage (P72), and is arranged in the auxiliary passage (P72) between the auxiliary expansion valve (72) and the other end of the first liquid connection pipe (P14). Each of the eighth check valve (CV8) and the ninth check valve (CV9) allows the refrigerant to flow in the direction of the arrows shown in FIG. 1 and prohibits the refrigerant from flowing in the opposite direction.

[Various Sensors in Utilization Unit]

Each utilization unit (15) is provided with various sensors, such as a pressure sensor and a temperature sensor (not shown). The various sensors detect physical quantities, such as the pressure and temperature of the high-pressure refrigerant in the refrigerant circuit (100), the pressure and temperature of the low-pressure refrigerant in the refrigerant circuit (100), the pressure and temperature of the refrigerant in the utilization heat exchanger (70), and the temperature of the air (the room air or the air inside the cold storage in this example) sucked into the utilization unit (15).

[Utilization Controller]

The utilization controller (18) is connected to the various sensors (i.e., the pressure sensors, the temperature sensors, etc.) provided in the utilization unit (15) via communication lines. The utilization controller (18) is connected to the components of the utilization unit (15) (i.e., the utilization expansion valve (71), the auxiliary expansion valve (72), the utilization fan (17), etc.) via communication lines. The utilization controller (18) controls the components of the utilization unit (15) based on detection signals of the various sensors provided in the utilization unit (15) (signals indicating detection results of the various sensors) and external signals (e.g., operation commands). For example, the utilization controller (18) includes a processor and a memory that stores programs and information for operating the processor.

[Controller]

In the refrigeration apparatus (1), the heat source controller (14) and one or more (two in this example) utilization controllers (18) constitute a controller (200). The controller (200) controls the components of the refrigeration apparatus (1) based on the detection signals from the various sensors provided in the refrigeration apparatus (1) and the external signals. Thus, the operation of the refrigeration apparatus (1) is controlled.

In this example, the heat source controller (14) and the utilization controllers (18) are connected to each other via communication lines. The heat source controller (14) and the utilization controllers (18) communicate with each other to control the components of the refrigeration apparatus (1). Specifically, the heat source controller (14) controls the components of the heat source unit (10), and controls the utilization controllers (18) to control the components of the utilization units (15). Thus, the heat source controller (14) controls the operation of the refrigeration apparatus (1) including the heat source unit (10) and the utilization units (15). The heat source controller (14) also controls the refrigerant circuit (100) including the heat source circuit (11) and the utilization circuit (16).

In this example, each utilization controller (18) transmits a start request signal for requesting a start of the compression element (20) to the heat source controller (14) depending on whether heat exchange in the utilization heat exchanger (70) (heat exchange between the air and the refrigerant in this example) is necessary. Whether the heat exchange in the utilization heat exchanger (70) is necessary may be determined based on the temperature of the air (the room air or the air inside the cold storage in this example) sucked into the utilization unit (15).

For example, for cooling the air by the utilization unit (15), the utilization controller (18) transmits the start request signal when the temperature of the air sucked into the utilization unit (15) exceeds a preset target temperature, i.e., when heat exchange in the utilization heat exchanger (70) is necessary. The utilization controller (18) adjusts the opening degree of the utilization expansion valve (71) by superheat control. For the superheat control, the utilization controller (18) adjusts the opening degree of the utilization expansion valve (71) so that the degree of superheat of the refrigerant at the outlet of the utilization heat exchanger (70) serving as an evaporator reaches a target degree of superheat. The utilization controller (18) transmits a stop request signal when the temperature of the air sucked into the utilization unit (15) is lowered to the target temperature, i.e., when heat exchange in the utilization heat exchanger (70) is no longer necessary. Then, the utilization controller (18) fully closes the utilization expansion valve (71).

The heat source controller (14) drives the compression element (20) in response to the start request signal transmitted from the utilization controller (18). The heat source controller (14) stops the compression element (20) when the stop request signal is transmitted from the utilization controllers (18) of all of the utilization units (15), i.e., when heat exchange in the utilization heat exchanger (70) is no longer necessary in each utilization unit (15).

[Operation of Refrigeration Apparatus]

The refrigeration apparatus (1) shown in FIG. 1 performs various operations, such as a cold storage running operation, a cooling operation, a cooling and cold storage running operation, a heating operation, and a heating and cold storage running operation.

<Cold Storage Running Operation>

The cold storage running operation will be described with reference to FIG. 2. In the cold storage running operation, the cold storage unit (15*b*) is operated and the indoor unit (15*a*) is stopped. In the cold storage running operation, a refrigeration cycle occurs in which the heat source heat exchanger (40) serves as a radiator, and the utilization heat exchanger (70) of the cold storage unit (15*b*) serves as an evaporator.

In the heat source unit (10) in the cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The second compressor (22) and the third compressor (23) are driven, and the first compressor (21) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is stopped, and the utilization expansion valve (71) and the auxiliary expansion valve (72) are fully closed. In the cold storage unit (15*b*), the utilization fan (17) is driven, and the opening degree of the utilization expansion valve (71) is adjusted by superheat control.

Figure 2:
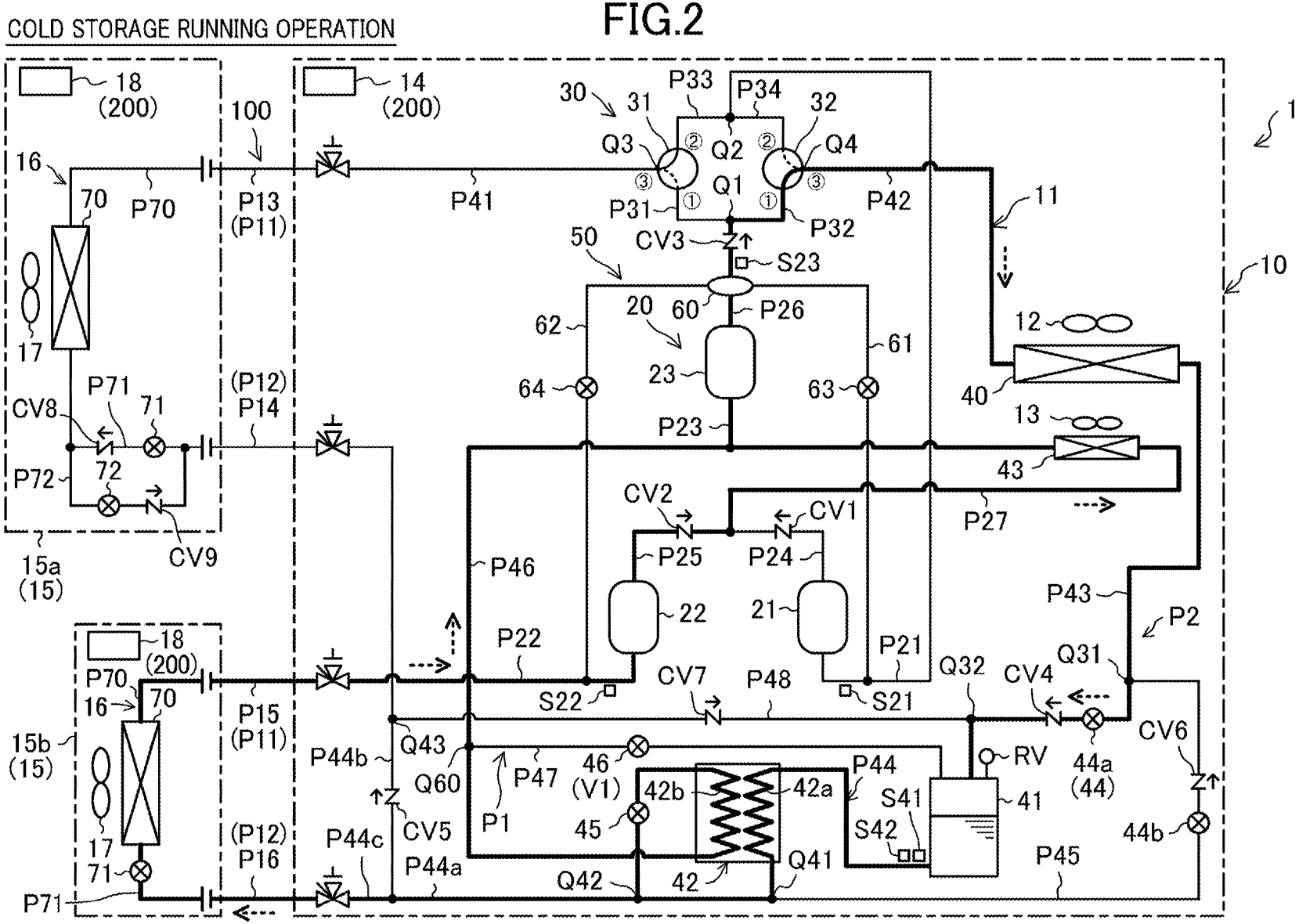
FIG. 2 is a piping system diagram illustrating how a refrigerant flows in a cold storage running operation.

As illustrated in FIG. 2, the refrigerant discharged from the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the cold storage unit (15*b*) via the fourth heat source passage (P44) and the second liquid connection pipe (P16).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Cooling Operation>

The cooling operation will be described with reference to FIG. 3. In the cooling operation, the indoor unit (15*a*) cools the inside of the room, and the cold storage unit (15*b*) is stopped. In the cooling operation, a refrigeration cycle occurs in which the heat source heat exchanger (40) serves as a radiator, and the utilization heat exchanger (70) of the indoor unit (15*a*) serves as an evaporator.

In the heat source unit (10) in the cooling operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21) and the third compressor (23) are driven, and the second compressor (22) is stopped. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is stopped and the utilization expansion valve (71) is fully closed.

Figure 3:
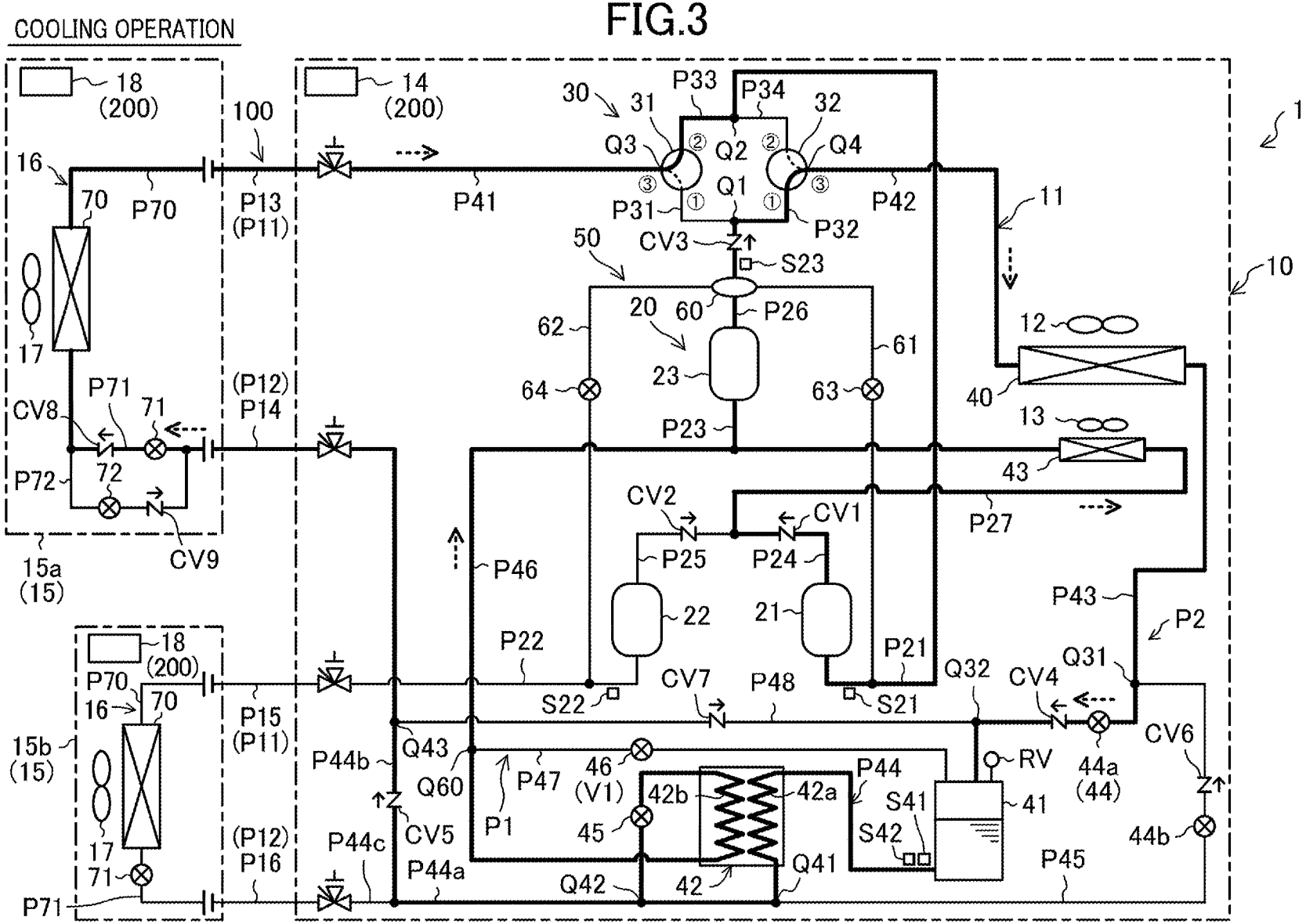
FIG. 3 is a piping system diagram illustrating how the refrigerant flows in a cooling operation.

As illustrated in FIG. 3, the refrigerant discharged from the first compressor (21) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder flows into the utilization liquid passage (P71) of the indoor unit (15*a*) via the fourth heat source passage (P44) and the first liquid connection pipe (P14).

The refrigerant that has flowed into the utilization liquid passage (P71) of the indoor unit (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Cooling and Cold Storage Running Operation>

The cooling and cold storage running operation will be described with reference to FIG. 4. In the cooling and cold storage running operation, the indoor unit (15*a*) cools the inside of the room, and the cold storage unit (15*b*) runs. In the cooling and cold storage running operation, a refrigeration cycle occurs in which the heat source heat exchanger (40) serves as a radiator, and the utilization heat exchanger (70) of the indoor unit (15*a*) and the utilization heat exchanger (70) of the cold storage unit (15*b*) serve as evaporators.

In the heat source unit (10) in the cooling and cold storage running operation, the first three-way valve (31) is brought into the second state, and the second three-way valve (32) is brought into the first state. This allows the first port (Q1) and fourth port (Q4) of the switching unit (30) to communicate with each other, and allows the second port (Q2) and the third port (Q3) to communicate with each other. The heat source fan (12) and the cooling fan (13) are driven. The first compressor (21), the second compressor (22), and the third compressor (23) are driven. The first heat source expansion valve (44*a*) is opened at a predetermined opening degree, the second heat source expansion valve (44*b*) and the venting valve (46) are fully closed, and the opening degree of the cooling expansion valve (45) is suitably adjusted. In the indoor unit (15*a*), the utilization fan (17) is driven, the opening degree of the utilization expansion valve (71) is adjusted by superheat control, and the auxiliary expansion valve (72) is fully closed. In the cold storage unit (15*b*), the utilization fan (17) is driven, and the opening degree of the utilization expansion valve (71) is adjusted by superheat control.

Figure 4:
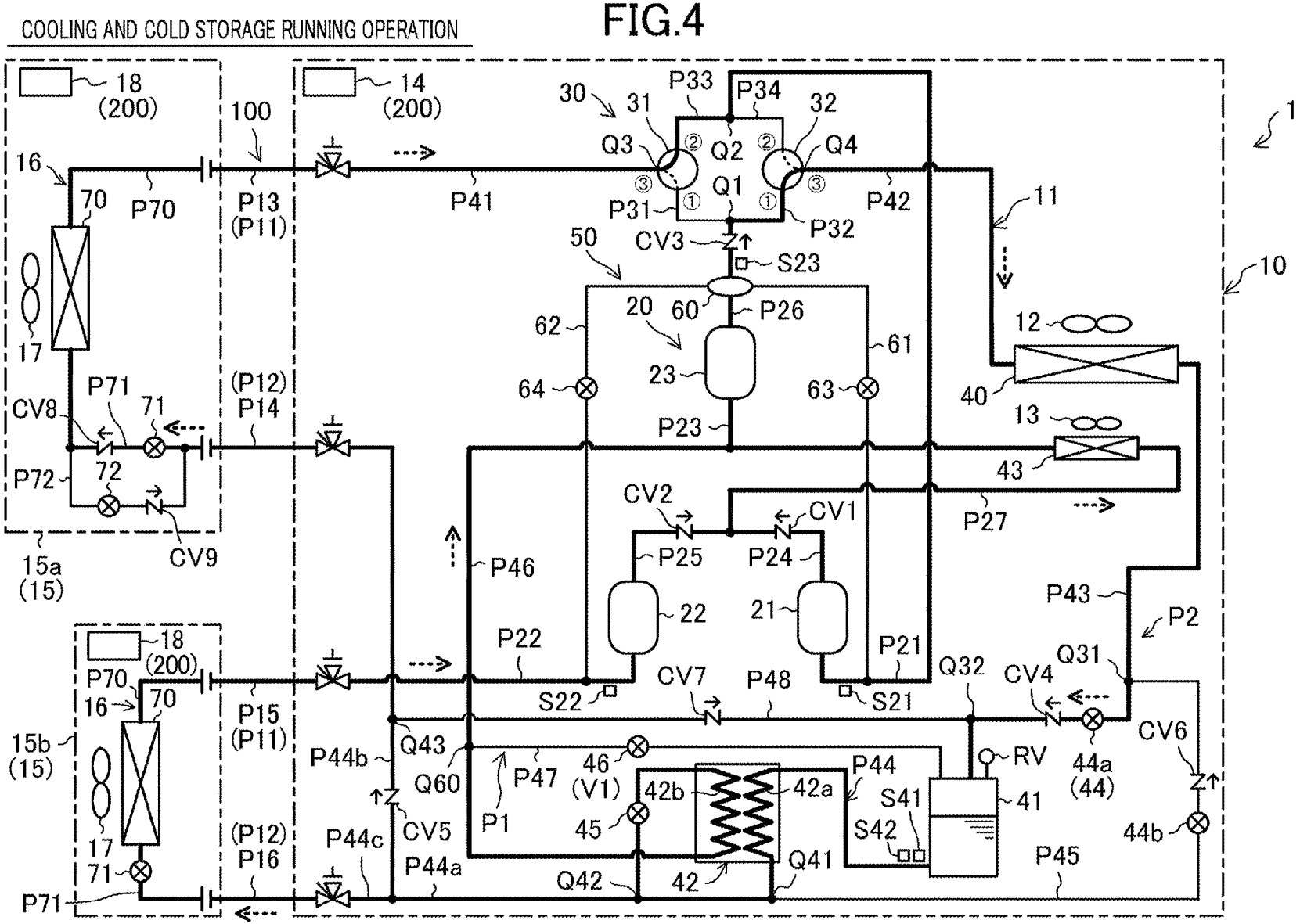
FIG. 4 is a piping system diagram illustrating how the refrigerant flows in a cooling and cold storage running operation.

As illustrated in FIG. 4, the refrigerant discharged from each of the first compressor (21) and the second compressor (22) is cooled in the intercooler (43), and is sucked into and compressed by the third compressor (23). The refrigerant discharged from the third compressor (23) flows into the second heat source passage (P42) via the switching unit (30), and dissipates heat in the heat source heat exchanger (40). The refrigerant that has flowed out of the heat source heat exchanger (40) passes through the first heat source expansion valve (44*a*) and the fourth check valve (CV4) which are open in the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the sixth heat source passage (P46), and the remainder diverges into the first liquid connection pipe (P14) and the second liquid connection pipe (P16). The refrigerant that has diverged into the first liquid connection pipe (P14) flows into the utilization liquid passage (P71) of the indoor unit (15*a*). The refrigerant that has diverged into the second liquid connection pipe (P16) flows into the utilization liquid passage (P71) of the cold storage unit (15*b*).

The refrigerant that has flowed into the utilization liquid passage (P71) of the indoor unit (15*a*) is decompressed by the utilization expansion valve (71), and absorbs heat from the room air in the utilization heat exchanger (70) to evaporate. Thus, the room air is cooled. The refrigerant that has flowed out of the utilization heat exchanger (70) passes through the utilization gas passage (P70), the first gas connection pipe (P13), the first heat source passage (P41), the switching unit (30), and the first suction passage (P21), and is sucked into and compressed by the first compressor (21).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Heating Operation>

The heating operation will be described with reference to FIG. 5. In the heating operation, the indoor unit (15*a*) heats the inside of the room, and the cold storage unit (15*b*) is stopped. In the heating operation, a refrigeration cycle occurs in which the utilization heat exchanger (70) of the indoor unit (15*a*) serves as a radiator, and the heat source heat exchanger (40) serves as an evaporator.

In the heat source unit (10) in the heating operation, the first three-way valve (31) is brought into the first state, and the second three-way valve (32) is brought into the second state. This allows the first port (Q1) and third port (Q3) of the switching unit (30) to communicate with each other, and allows the second port (Q2) and the fourth port (Q4) to communicate with each other. The heat source fan (12) is driven, and the cooling fan (13) is stopped. The first compressor (21) and the third compressor (23) are driven, and the second compressor (22) is stopped. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*b*), the utilization fan (17) is stopped and the utilization expansion valve (71) is fully closed.

Figure 5:
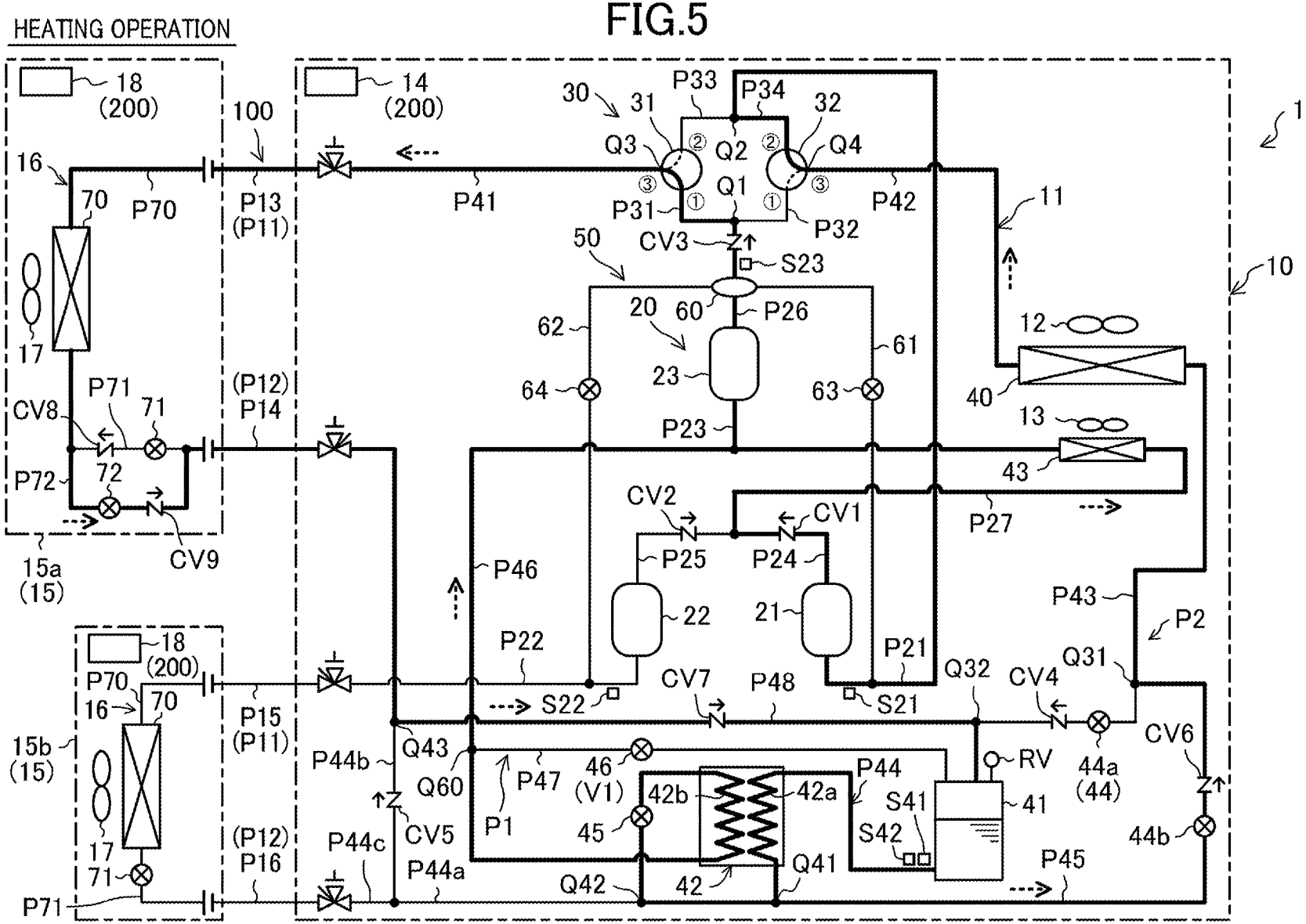
FIG. 5 is a piping system diagram illustrating how the refrigerant flows in a heating operation.

As illustrated in FIG. 5, the refrigerant discharged from the first compressor (21) flows through the intercooler (43), and is sucked into and compressed by the third compressor (23). The refrigerant discharged from the third compressor (23) passes through the switching unit (30), the first heat source passage (P41), and the first gas connection pipe (P13), and flows into the utilization gas passage (P70) of the indoor unit (15*a*).

The refrigerant that has flowed into the utilization gas passage (P70) of the indoor unit (15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder flows into the sixth heat source passage (P46).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

<Heating and Cold Storage Running Operation>

Figure 6:
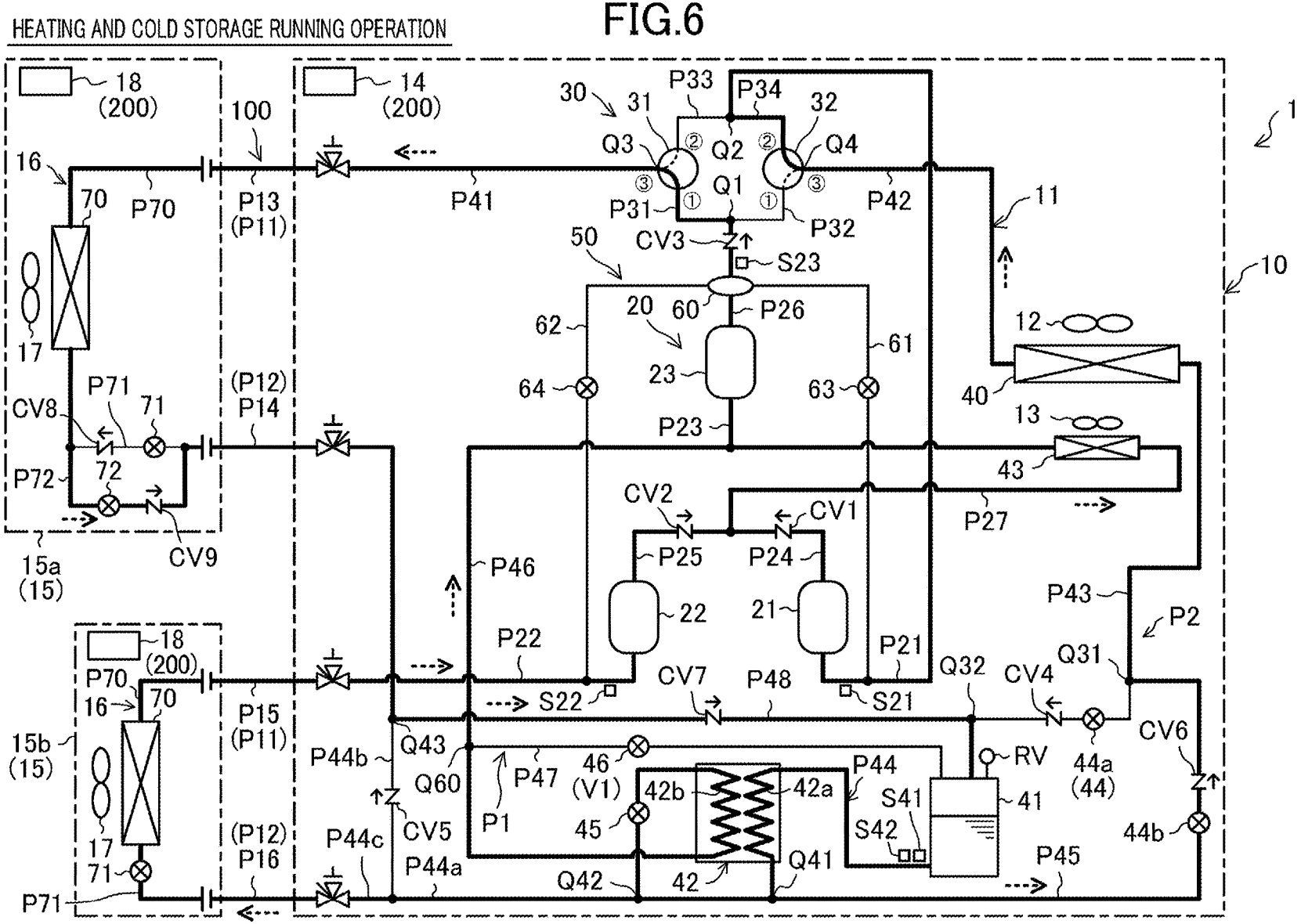
FIG. 6 is a piping system diagram illustrating how the refrigerant flows in a heating and cold storage running operation.

The heating and cold storage running operation will be described with reference to FIG. 6. In the heating and cold storage running operation, the indoor unit (15*a*) heats the inside of the room, and the cold storage unit (15*b*) runs. In the heating and cold storage running operation, a refrigeration cycle occurs in which the utilization heat exchanger (70) of the indoor unit (15*a*) serves as a radiator, and the heat source heat exchanger (40) and the utilization heat exchanger (70) of the cold storage unit (15*b*) serve as evaporators.

In the heating and cold storage running operation, the first three-way valve (31) is brought into the first state, and the second three-way valve (32) is brought into the second state. The heat source fan (12) is driven, and the cooling fan (13) is stopped. The first port (Q1) and the third port (Q3) of the switching unit (30) communicate with each other, and the second port (Q2) and the fourth port (Q4) communicate with each other. The first compressor (21), the second compressor (22), and the third compressor (23) are driven. The opening degree of the second heat source expansion valve (44*b*) is adjusted by superheat control, the first heat source expansion valve (44*a*) and the venting valve (46) are fully closed, and the opening degree of the cooling expansion valve (45) is suitably adjusted. In the indoor unit (15*a*), the utilization fan (17) is driven, the utilization expansion valve (71) is fully closed, and the auxiliary expansion valve (72) is opened at a predetermined opening degree. In the cold storage unit (15*b*), the utilization fan (17) is driven, and the opening degree of the utilization expansion valve (71) is adjusted by superheat control.

In the heating and cold storage running operation, the refrigerant discharged from each of the first compressor (21) and the second compressor (22) flows through the intercooler (43), and is sucked into and compressed by the third compressor (23). The refrigerant discharged from the third compressor (23) passes through the switching unit (30), the first heat source passage (P41), and the first gas connection pipe (P13), and flows into the utilization gas passage (P70) of the indoor unit (15*a*).

The refrigerant that has flowed into the utilization gas passage (P70) of the indoor unit (15*a*) dissipates heat to the room air in the utilization heat exchanger (70). Thus, the room air is heated. The refrigerant that has flowed out of the utilization heat exchanger (70) passes through the auxiliary expansion valve (72) and the ninth check valve (CV9) which are open in the auxiliary passage (P72), and flows into the fourth heat source passage (P44) of the heat source unit (10) via the first liquid connection pipe (P14).

The refrigerant that has flowed into the fourth heat source passage (P44) in the heat source unit (10) passes through the eighth heat source passage (P48) and the third heat source passage (P43), and flows into the receiver (41) to be collected therein. The refrigerant (liquid refrigerant) that has flowed out of the liquid outlet of the receiver (41) flows into the fourth heat source passage (P44), and is cooled in the first refrigerant passage (42*a*) of the cooling heat exchanger (42) through heat absorption by the refrigerant flowing through the second refrigerant passage (42*b*) of the cooling heat exchanger (42). Part of the refrigerant that has flowed out of the first refrigerant passage (42*a*) of the cooling heat exchanger (42) flows into the fifth heat source passage (P45), and the remainder diverges into the second liquid connection pipe (P16) and the sixth heat source passage (P46). The refrigerant that has diverged into the second liquid connection pipe (P16) flows into the utilization liquid passage (P71) of the cold storage unit (15*b*).

The refrigerant that has flowed into the fifth heat source passage (P45) in the heat source unit (10) is decompressed by the second heat source expansion valve (44*b*), flows into the heat source heat exchanger (40) via the third heat source passage (P43), and absorbs heat from the outdoor air in the heat source heat exchanger (40) to evaporate. The refrigerant that has flowed out of the heat source heat exchanger (40) passes through the second heat source passage (P42), the switching unit (30), and the first suction passage (P21), and is sucked into and compressed by the first compressor (21).

The refrigerant that has flowed into the sixth heat source passage (P46) in the heat source unit (10) is decompressed by the cooling expansion valve (45), and absorbs heat in the second refrigerant passage (42*b*) of the cooling heat exchanger (42) from the refrigerant flowing through the first refrigerant passage (42*a*) of the cooling heat exchanger (42). The refrigerant that has flowed out of the second refrigerant passage (42*b*) of the cooling heat exchanger (42) passes through the sixth heat source passage (P46) and the third suction passage (P23), and is sucked into and compressed by the third compressor (23).

The refrigerant that has flowed into the utilization liquid passage (P71) of the cold storage unit (15*b*) is decompressed by the utilization expansion valve (71), and absorbs heat from the air inside the cold storage in the utilization heat exchanger (70) to evaporate. Thus, the air inside the cold storage is cooled. The refrigerant that has flowed out of the utilization heat exchanger (70) passes through the utilization gas passage (P70), the second gas connection pipe (P15), and the second suction passage (P22), and is sucked into and compressed by the second compressor (22).

[Details of Heat Source Circuit]

The heat source circuit (11) in the refrigeration apparatus (1) includes a gas passage (P1), an on-off valve (V1), a connection passage (P2), and a heat source expansion valve (44).

<Gas Passage>

The gas passage (P1) is a passage that allows the inlet of the compression element (20) to communicate with the receiver (41). In this example, the gas passage (P1) includes part of the sixth heat source passage (P46) and the seventh heat source passage (P47). Specifically, the gas passage (P1) includes part of the sixth heat source passage (P46) between an intermediate portion (Q60) and other end of the sixth heat source passage (P46) (a junction of the sixth heat source passage (P46) with the third suction passage (P23)), and the seventh heat source passage (P47). The gas passage (P1) allows the suction port of the third compressor (23), which is an example of the inlet of the compression element (20), to communicate with the gas outlet of the receiver (41).

<On-Off Valve>

The on-off valve (V1) is a valve provided in the gas passage (P1). The on-off valve (V1) is switchable between an open state and a closed state. In this example, the on-off valve (V1) is constituted of a venting valve (46).

<Connection Passage>

The connection passage (P2) is a passage that allows the heat source heat exchanger (40) to communicate with the receiver (41). In this example, the connection passage (P2) is constituted of the third heat source passage (P43). The connection passage (P2) allows the liquid end of the heat source heat exchanger (40) to communicate with the inlet of the receiver (41).

<Heat Source Expansion Valve>

The heat source expansion valve (44) is a valve provided in the connection passage (P2). The heat source expansion valve (44) has a variable opening degree. In this example, the heat source expansion valve (44) is constituted of the first heat source expansion valve (44*a*).

[First Operation]

In the refrigeration apparatus (1), the heat source controller (14) performs a first operation when the compression element (20) is in a stopped state and the pressure (RP) in the receiver (41) exceeds a predetermined first pressure (Pth1). The heat source controller (14) allows the inlet of the compression element (20) to communicate with the receiver (41), and drives the compression element (20) in the first operation. In other words, in the first operation, the heat source controller (14) brings the heat source circuit (11) into a state in which the inlet of the compression element (20) communicates with the receiver (41) and the compression element (20) is driven.

Specifically, in the first operation, the heat source controller (14) opens the on-off valve (V1) provided in the gas passage (P1) that allows the inlet of the compression element (20) to communicate with the receiver (41). This allows communication between the inlet of the compression element (20) and the receiver (41). The opening degree of the on-off valve (V1) in the first operation may be the maximum, or may be smaller than the maximum. The opening degree of the on-off valve (V1) in the first operation may be fixed or variable. For example, in the first operation, the heat source controller (14) may adjust the opening degree of the on-off valve (V1) so that a predetermined amount of refrigerant moves from the receiver (41) to the compression element (20).

Note that the first pressure (Pth1) is set to, for example, a pressure at which the receiver (41) can be protected against damage caused by high pressure. In this example, the first pressure (Pth1) is lower than the operating pressure of the pressure release valve (RV). As a specific example, the first pressure (Pth1) is set to 8.5 MPa when the refrigerant is carbon dioxide.

The refrigerant that has been discharged from the compression element (20) is supplied to the heat source heat exchanger (40) in the first operation. Specifically, the heat source controller (14) controls the heat source circuit (11) in the first operation so that the refrigerant that has been discharged from the compression element (20) is supplied to the heat source heat exchanger (40). In other words, in the first operation, the heat source controller (14) brings the heat source circuit (11) into a state in which the refrigerant that has been discharged from the compression element (20) is supplied to the heat source heat exchanger (40).

The heat source controller (14) controls the heat source expansion valve (44) in the first operation so that the refrigerant that has flowed out of the heat source heat exchanger (40) is decompressed by the heat source expansion valve (44) and supplied to the receiver (41). Specifically, the heat source controller (14) opens the heat source expansion valve (44) in the first operation. The opening degree of the heat source expansion valve (44) in the first operation is smaller than the maximum.

The heat source controller (14) ends the first operation when the pressure (RP) in the receiver (41) falls below a predetermined second pressure (Pth2). The second pressure (Pth2) is lower than the first pressure (Pth1). For example, the second pressure (Pth2) is set to a level at which the pressure (RP) in the receiver (41) can be considered to be sufficiently lowered. As a specific example, the second pressure (Pth2) is set to 5 MPa when the refrigerant is carbon dioxide. The heat source controller (14) fully closes the heat source expansion valve (44) after the first operation ends.

In the first operation, the heat source controller (14) drives any one of the plurality of compressors included in the compression element (20) (the third compressor (23) in this example). The number of rotations of the compressor driven in the first operation is set to a predetermined number of rotations (e.g., a minimum number of rotations).

[Details of First Operation]

Figure 7:
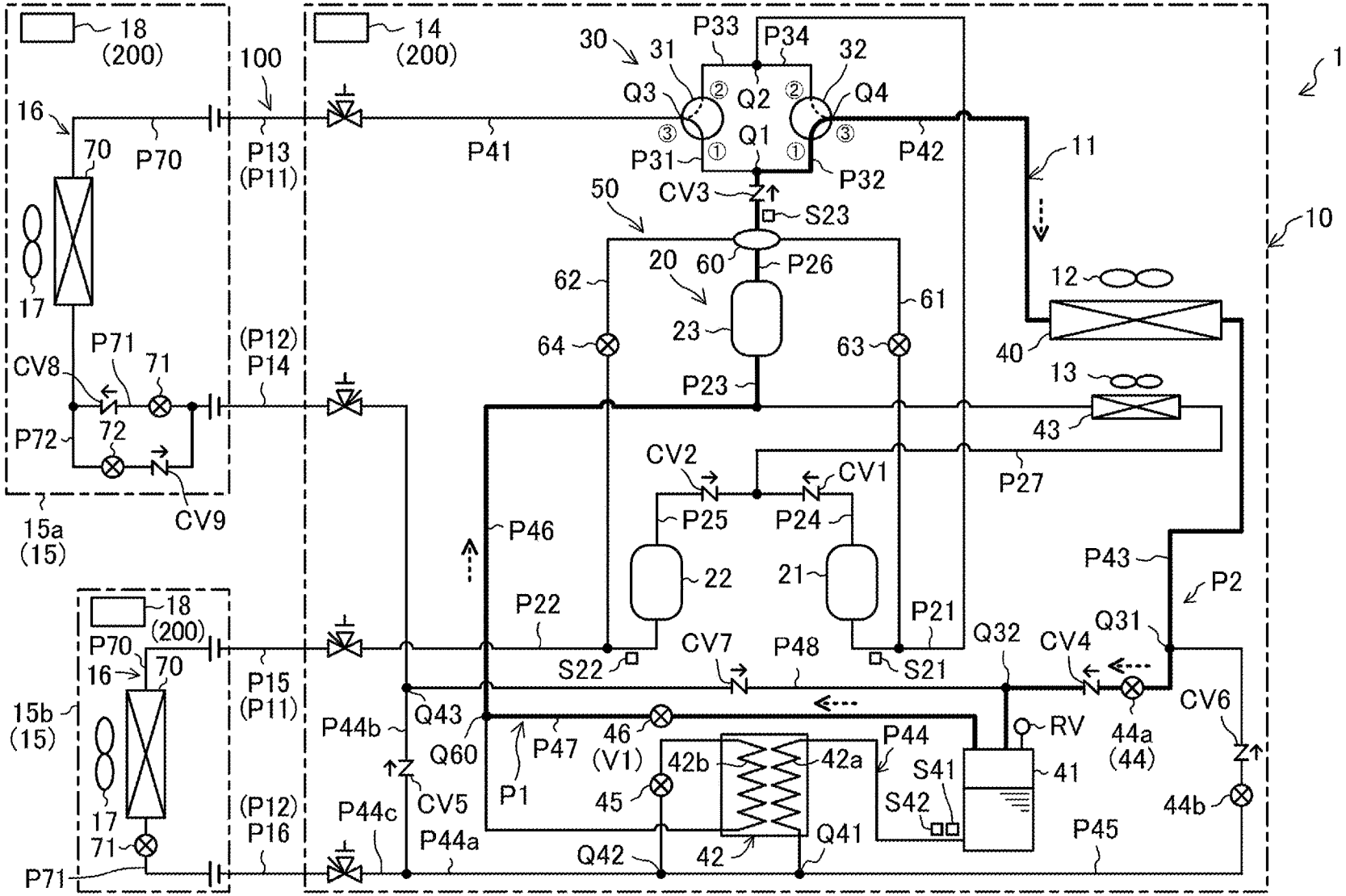
FIG. 7 is a piping system diagram illustrating how the refrigerant flows in a first operation.

As illustrated in FIG. 7, the second three-way valve (32) in the heat source unit (10) is in the first state during the first operation. For example, the heat source controller (14) switches the second three-way valve (32) to the first state as necessary. Thus, the first port (Q1) and fourth port (Q4) of the switching unit (30) communicate with each other, and the outlet of the compression element (20) (the discharge port of the third compressor (23) in this example) communicates with the gas end of the heat source heat exchanger (40). The heat source controller (14) opens the on-off valve (V1) (the venting valve (46) in this example). This allows communication between the inlet of the compression element (20) (the suction port of the third compressor (23) in this example) and the gas outlet of the receiver (41). The heat source controller (14) suitably adjusts the opening degree of the heat source expansion valve (44) (the first heat source expansion valve (44*a*) in this example). This allows communication between the liquid end of the heat source heat exchanger (40) and the inlet of the receiver (41). The heat source controller (14) drives the compression element (20). In this example, the heat source controller (14) drives the third compressor (23), and keeps the first compressor (21) and the second compressor (22) in the stopped state.

In the first operation, the heat source controller (14) drives the heat source fan (12) and stops the cooling fan (13) in the heat source unit (10). The heat source controller (14) fully closes the second heat source expansion valve (44*b*) and the cooling expansion valve (45). The utilization controller (18) in the indoor unit (15*a*) stops the utilization fan (17), and fully closes the utilization expansion valve (71) and the auxiliary expansion valve (72). The utilization controller (18) in the cold storage unit (15*b*) stops the utilization fan (17), and fully closes the utilization expansion valve (71).

As illustrated in FIG. 7, when the third compressor (23) (the compression element (20)) is driven, the refrigerant in the receiver (41) flows out of the receiver (41). The refrigerant that has flowed out of the receiver (41) moves to the suction port of the third compressor (23) (the inlet of the compression element (20)) through the gas passage (P1). Specifically, the refrigerant that has flowed out of the gas outlet of the receiver (41) enters the gas passage (P1), passes through the on-off valve (V1) which is open in the gas passage (P1), and is sucked into the suction port of the third compressor (23). The refrigerant discharged from the third compressor (23) passes through the third discharge passage (P26), the switching unit (30), and the second heat source passage (P42), and flows into the heat source heat exchanger (40). The refrigerant that has flowed out of the heat source heat exchanger (40) flows into the connection passage (P2), is decompressed by the heat source expansion valve (44), and then flows into the inlet of the receiver (41).

[Pump-Down Operation]

In this refrigeration apparatus (1), the heat source controller (14) performs a pump-down operation before the compression element (20) stops. In the pump-down operation, the heat source controller (14) controls the refrigerant circuit (100) so that the refrigerant in the utilization heat exchanger (70) is recovered to the heat source circuit (11).

In the heat source unit (10) during the pump-down operation, the first three-way valve (31) is brought into the second state, and the second three-way valve (32) is brought into the first state. Specifically, the heat source controller (14) switches the first three-way valve (31) to the second state, and switches the second three-way valve (32) to the first state, as needed. Thus, the first port (Q1) and fourth port (Q4) of the switching unit (30) communicate with each other, the second port (Q2) and the third port (Q3) communicate with each other, the inlet of the compression element (20) communicates with the gas end of the utilization circuit (16) of the utilization unit (15), and the outlet of the compression element (20) communicates with the gas end of the heat source heat exchanger (40). In this example, the suction port of the first compressor (21) communicates with the gas end of the utilization circuit (16) of the indoor unit (15*a*), and the discharge port of the third compressor (23) communicates with the gas end of the heat source heat exchanger (40). The suction port of the second compressor (22) communicates with the gas end of the utilization circuit (16) of the cold storage unit (15*b*) through the second suction passage (P22) and the second gas connection pipe (P15). The heat source controller (14) drives the compression element (20). In this example, the heat source controller (14) drives the first compressor (21), the second compressor (22), and the third compressor (23).

In the pump-down operation, the heat source controller (14) drives the heat source fan (12) and the cooling fan (13)

in the heat source unit (10). The heat source controller (14) fully opens the first heat source expansion valve (44*a*) (heat source expansion valve (44)), fully closes the second heat source expansion valve (44*b*) and the venting valve (46), and suitably adjusts the opening degree of the cooling expansion valve (45). The utilization controller (18) in the indoor unit (15*a*) drives the utilization fan (17), and fully closes the utilization expansion valve (71) and the auxiliary expansion valve (72). The utilization controller (18) in the cold storage unit (15*b*) drives the utilization fan (17), and fully closes the utilization expansion valve (71).

When the compression element (20) is driven in the pump-down operation, the refrigerant in the utilization heat exchanger (70) of the utilization circuit (16) of the indoor unit (15*a*) flows out of the utilization heat exchanger (70), passes through the utilization gas passage (P70) of the indoor unit (15*a*) and the first gas connection pipe (P13) to flow into the first heat source passage (P41) of the heat source circuit (11) of the heat source unit (10), and is sucked into the compression element (20) (i.e., the first compressor (21)) through the first heat source passage (P41), the switching unit (30), and the first suction passage (P21). The refrigerant in the utilization heat exchanger (70) of the utilization circuit (16) of the cold storage unit (15*b*) flows out of the utilization heat exchanger (70), passes through the utilization gas passage (P70) of the cold storage unit (15*b*) and the second gas connection pipe (P15) to flow into the second suction passage (P22) of the heat source circuit (11) of the heat source unit (10), and is sucked into the compression element (20) (i.e., the second compressor (22)). The refrigerant discharged from the compression element (20) (i.e., the third compressor (23)) passes through the switching unit (30), the second heat source passage (P42), the heat source heat exchanger (40), and the third heat source passage (P43), and flows into the receiver (41) to be collected therein.

When a predetermined pump-down termination condition is met, the heat source controller (14) ends the pump-down operation. Examples of the pump-down termination condition include a condition that the pressure of the refrigerant on the suction side of the compression element (20) (the pressure on the suction side of the first compressor (21) or the second compressor (22)) falls below a predetermined stop pressure, a condition that a predetermined time has elapsed from the start of the pump-down operation, etc. After the pump-down operation ends, the heat source controller (14) stops the compression element (20), and fully closes the first heat source expansion valve (44*a*) (the heat source expansion valve (44)).

[Operation Control During Stop of Compression Element]

Figure 8:
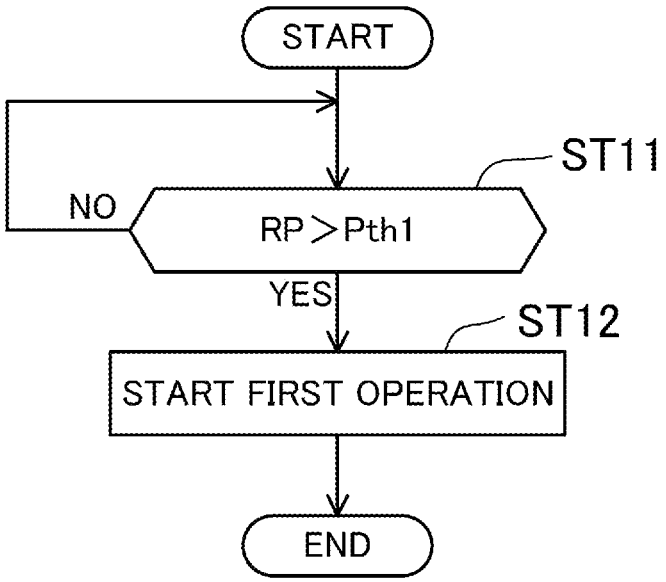
FIG. 8 is a flowchart illustrating operation control during a stop of a compression element.

Next, operation control by the heat source controller (14) during the stop of the compression element (20) will be described with reference to FIG. 8.

<Step (ST11)>

First, the heat source controller (14) determines whether the pressure (RP) in the receiver (41) exceeds the first pressure (Pth1). For example, the receiver pressure sensor (S41) detects the pressure (RP) in the receiver (41). The heat source controller (14) may determine whether the pressure detected by the receiver pressure sensor (S41) exceeds the first pressure (Pth1). The pressure (RP) in the receiver (41) may be derived from a temperature detected by the receiver temperature sensor (S42) (temperature in the receiver (41)). The heat source controller (14) may determine whether the pressure (RP) in the receiver (41) derived from the temperature in the receiver (41) exceeds the first pressure (Pth1). The processing of Step (ST11) is repeated until the pressure (RP) in the receiver (41) exceeds the first pressure (Pth1), and the processing of Step (ST12) is performed when the pressure (RP) in the receiver (41) exceeds the first pressure (Pth1).

<Step (ST12)>

When the pressure (RP) in the receiver (41) exceeds the first pressure (Pth1), the heat source controller (14) starts the first operation. In this example, the heat source controller (14) opens the venting valve (46), which is an example of the on-off valve (V1), and drives the third compressor (23) of the compression element (20).

[Operation Control During First Operation]

Figure 9:
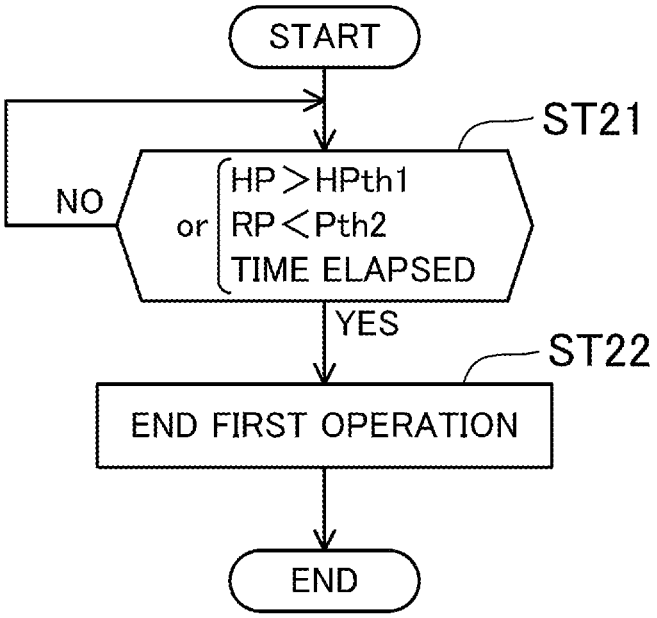
FIG. 9 is a flowchart illustrating operation control during the first operation.

Next, the operation control by the heat source controller (14) during the first operation will be described with reference to FIG. 9.

<Step (ST21)>

First, the heat source controller (14) determines whether at least one of a first termination condition, a second termination condition, or a third termination condition is met.

The first termination condition is a condition that the pressure (HP) of the refrigerant discharged from the compression element (20) exceeds a predetermined first high pressure (HPth1). For example, the discharge pressure sensor (S23) detects the pressure (HP) of the refrigerant discharged from the compression element (20). The heat source controller (14) may determine whether the pressure detected by the discharge pressure sensor (S23) exceeds the first high pressure (HPth1). For example, the first high pressure (HPth1) is set to a pressure at which the compression element (20) can be protected against damage caused by high pressure. As a specific example, the first high pressure (HPth1) is set to 11 MPa when the refrigerant is carbon dioxide. The second termination condition is a condition that the pressure (RP) in the receiver (41) falls below a predetermined second pressure (Pth2). The third termination condition is a condition that a predetermined operating time has elapsed from the start of the first operation. For example, the operating time is set to a time for which the pressure (RP) in the receiver (41) can be considered to be sufficiently lowered by the continuation of the first operation.

The processing of Step (ST21) is repeated until at least one of the first, second, or third termination condition is met, and the processing of Step (ST22) is performed when at least one of the first, second, or third termination condition is met.

<Step (ST22)>

The heat source controller (14) ends the first operation. The heat source controller (14) stops the compression element (20) being driven. In this example, the heat source controller (14) fully closes the heat source expansion valve (44) after the first operation ends.

[Control of Heat Source Expansion Valve During First Operation]

Figure 10:
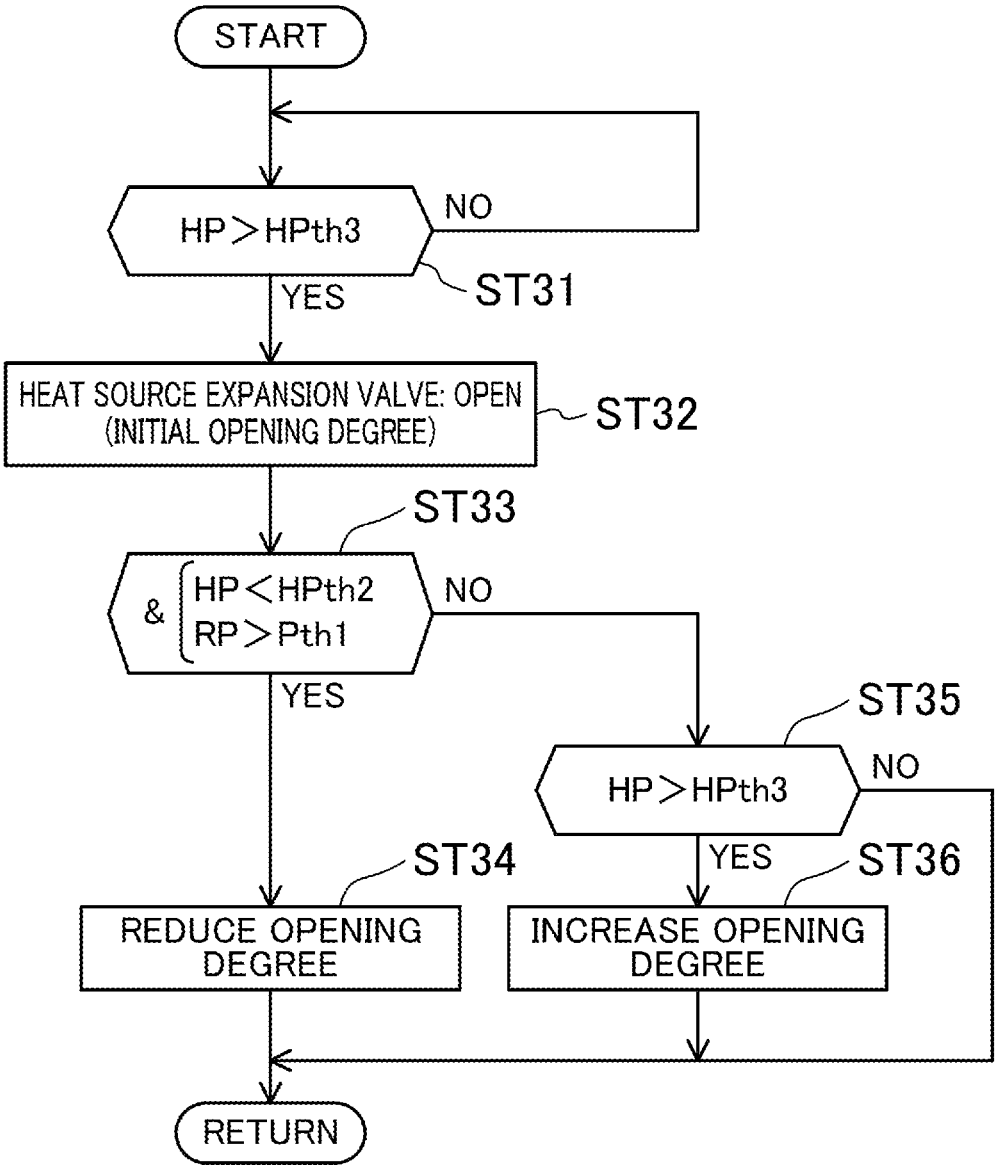
FIG. 10 is a flowchart illustrating control of an opening degree of a heat source expansion valve during the first operation.

Next, how the heat source expansion valve (44) is controlled during the first operation will be described with reference to FIG. 10. The heat source controller (14) repeatedly performs the following processing during the first operation.

<Step (ST31)>

First, the heat source controller (14) determines whether the pressure (HP) of the refrigerant discharged from the compression element (20) exceeds a third high pressure (HPth3). For example, the third high pressure (HPth3) is set to 9.5 MPa when the refrigerant is carbon dioxide. The processing of Step (ST31) is repeated until the pressure (HP) of the refrigerant discharged from the compression element (20) exceeds the third high pressure (HPth3), and the processing of Step (ST32) is performed when the pressure (HP) of the refrigerant discharged from the compression element (20) exceeds the third high pressure (HPth3).

<Step (ST32)>

When the pressure (HP) of the refrigerant discharged from the compression element (20) exceeds the third high pressure (HPth3), the heat source controller (14) opens the heat source expansion valve (44). Specifically, the heat source controller (14) sets the opening degree of the heat source expansion valve (44) to a predetermined initial opening degree.

<Step (ST33)>

Then, the heat source controller (14) determines whether both of a first condition and a second condition are met.

The first condition is a condition that the pressure (HP) of the refrigerant discharged from the compression element (20) falls below a predetermined second high pressure (HPth2). The second high pressure (HPth2) is lower than the first high pressure (HPth1). For example, the second high pressure (HPth2) is set to a level at which the pressure (HP) of the refrigerant discharged from the compression element (20) can be considered to be sufficiently lowered. As a specific example, the second high pressure (HPth2) is set to 10.5 MPa when the refrigerant is carbon dioxide. The second condition is a condition that the pressure (RP) in the receiver (41) exceeds the first pressure (Pth1).

If both of the first and second conditions are met, the processing of Step (ST34) is performed. Otherwise, the processing of Step (ST35) is performed.

<Step (ST34)>

The heat source controller (14) reduces the opening degree of the heat source expansion valve (44). This allows the heat source expansion valve (44) to further decompress the refrigerant, making it possible to accelerate the reduction of the pressure (RP) in the receiver (41). In the first operation, if reducing the opening degree of the heat source expansion valve (44) causes the heat source expansion valve (44) to be fully closed, the heat source controller (14) does not reduce the opening degree of the heat source expansion valve (44).

<Step (ST35)>

When both of the first and second conditions are not met, the heat source controller (14) determines whether the pressure (HP) of the refrigerant discharged from the compression element (20) exceeds the third high pressure (HPth3). If the pressure (HP) of the refrigerant discharged from the compression element (20) exceeds the third high pressure (HPth3), the processing of Step (ST36) is performed, and otherwise, the processing ends.

<Step (ST36)>

The heat source controller (14) increases the opening degree of the heat source expansion valve (44). This can lower the pressure (HP) of the refrigerant discharged from the compression element (20), making it possible to protect the compression element (20) from damage under high temperature.

[Feature (1) of Embodiment]

As described above, the heat source unit (10) of the present embodiment is the heat source unit (10) of the refrigeration apparatus (1), and includes: a heat source circuit (11) having a compression element (20), a heat source heat exchanger (40), and a receiver (41); and a heat source controller (14) configured to perform a first operation when the compression element (20) is in a stopped state and a pressure (RP) in the receiver (41) exceeds a predetermined first pressure (Pth1). The heat source controller (14) allows the inlet of the compression element (20) to communicate with the receiver (41), and drives the compression element (20) in the first operation.

In the present embodiment, the inlet of the compression element (20) communicates with the receiver (41), and the compression element (20) is driven in the first operation. This allows a refrigerant in the receiver (41) to move to the compression element (20). This can lower the pressure (RP) in the receiver (41), keeping the pressure in the receiver (41) from becoming abnormal.

In the first operation, the refrigerant in the receiver (41) moves to the compression element (20), promoting evaporation (self-evaporation) of the liquid refrigerant in the receiver (41). This can lower the temperature in the receiver (41).

Keeping the pressure in the receiver (41) from becoming abnormal can lower the level of pressure resistance (resistance to pressure) required for the receiver (41). For example, the receiver (41) can be thinned down. This can reduce the cost of the receiver (41).

In the event of an abnormality such as a fire, the temperature around the receiver (41) rises fast. Thus, the pressure (RP) in the receiver (41) needs to be reduced quickly. In the present embodiment, driving the compression element (20) can quickly discharge the refrigerant from the receiver (41), thereby quickly reducing the pressure (RP) in the receiver (41).

[Feature (2) of Embodiment]

The heat source unit (10) of the present embodiment has the heat source circuit (11) including the gas passage (P1) that allows the inlet of the compression element (20) to communicate with the receiver (41), and the on-off valve (V1) provided in the gas passage (P1). The heat source controller (14) opens the on-off valve (V1) in the first operation.

In the present embodiment, the on-off valve (V1) provided in the gas passage (P1) is opened in the first operation, thereby allowing the inlet of the compression element (20) to communicate with the receiver (41). This can drive the compression element (20) to let the refrigerant in the receiver (41) move to the compression element (20), thereby lowering the pressure (RP) in the receiver (41). Thus, the pressure in the receiver (41) can be kept from becoming abnormal.

[Feature (3) of Embodiment]

In the heat source unit (10) of the present embodiment, the refrigerant that has been discharged from the compression element (20) in the first operation is supplied to the heat source heat exchanger (40).

In the present embodiment, the refrigerant that has been discharged from the compression element (20) is supplied to the heat source heat exchanger (40) in the first operation. This allows the refrigerant discharged from the receiver (41) to move to the compression element (20) and the heat source heat exchanger (40). Thus, the amount of refrigerant discharged from the receiver (41) can be increased, compared to a case in which the refrigerant discharged from the receiver (41) is moved only to the compression element (20). This can further lower the pressure (RP) in the receiver (41), further keeping the pressure in the receiver (41) from becoming abnormal.

[Feature (4) of Embodiment]

The heat source unit (10) of the present embodiment has the heat source circuit (11) including the connection passage (P2) that allows the heat source heat exchanger (40) to communicate with the receiver (41).

In the present embodiment, provision of the connection passage (P2) allows the refrigerant that has been discharged from the receiver (41) to move to the compression element (20), the heat source heat exchanger (40), and the connection passage (P2) in the first operation. Thus, the amount of refrigerant discharged from the receiver (41) can be increased, compared to a case in which the refrigerant discharged from the receiver (41) is moved only to the compression element (20) and the heat source heat exchanger (40). This can further lower the pressure (RP) in the receiver (41), further keeping the pressure in the receiver (41) from becoming abnormal.

[Feature (5) of Embodiment]

The heat source unit (10) of the present embodiment has the heat source circuit (11) including the heat source expansion valve (44) provided in the connection passage (P2). The heat source controller (14) controls the heat source expansion valve (44) in the first operation so that the refrigerant that has flowed out of the heat source heat exchanger (40) is decompressed by the heat source expansion valve (44) and supplied to the receiver (41).

In the present embodiment, the refrigerant that has flowed out of the heat source heat exchanger (40) is decompressed by the heat source expansion valve (44), and then supplied to the receiver (41). This can return the refrigerant discharged from the receiver (41) and decompressed to the receiver (41). Thus, the pressure (RP) in the receiver (41) can be lower, compared to a case in which the refrigerant discharged from the receiver (41) is returned to the receiver (41) without decompression. Thus, the pressure in the receiver (41) can be kept from becoming abnormal.

[Feature (6) of Embodiment]

The heat source unit (10) of the present embodiment has the heat source circuit (11) including the heat source expansion valve (44) provided in the connection passage (P2). The heat source controller (14) fully closes the heat source expansion valve (44) after the first operation ends.

In the present embodiment, the heat source expansion valve (44) provided in the connection passage (P2) that allows the heat source heat exchanger (40) to communicate with the receiver (41) is fully closed after the first operation ends. This can block the refrigerant from flowing between the receiver (41) and the heat source heat exchanger (40). This can block the high-pressure refrigerant in the heat source heat exchanger (40) from flowing into the receiver (41) through the connection passage (P2). This can also block the refrigerant in the receiver (41) from flowing into the heat source heat exchanger (40) through the connection passage (P2).

[Feature (7) of Embodiment]

In the heat source unit (10) of the present embodiment, the heat source controller (14) ends the first operation when the pressure (RP) in the receiver (41) falls below the second pressure (Pth2) which is lower than the first pressure (Pth1).

In the present embodiment, the first operation ends when the pressure (RP) in the receiver (41) falls below the second pressure (Pth2). Thus, the first operation can be finished when the pressure (RP) in the receiver (41) is sufficiently lowered. This can reduce the occurrence of a phenomenon (so-called hunting) in which the start and the end of the first operation are frequently repeated.

[Feature (8) of Embodiment]

In the heat source unit (10) of the present embodiment, the heat source circuit (11) has the pressure release valve (RV) configured to operate when the pressure (RP) in the receiver (41) exceeds a predetermined operating pressure. The first pressure (Pth1) is lower than the operating pressure.

In the present embodiment, the first pressure (Pth1), which is a criterion for determining whether the first operation needs to be performed, is set lower than the operating pressure of the pressure release valve (RV). Thus, the first operation can be started before the pressure (RP) in the receiver (41) exceeds the operating pressure of the pressure release valve (RV) and the pressure release valve (RV) is actuated. This can reduce the pressure (RP) in the receiver (41) before the pressure release valve (RV) is actuated.

[Feature (9) of Embodiment]

In the heat source unit (10) of the present embodiment, the heat source circuit (11) is connected to the utilization circuit (16) having the utilization heat exchanger (70) to form the refrigerant circuit (100) that performs a refrigeration cycle. The heat source controller (14) controls the refrigerant circuit (100) so that the refrigerant in the utilization heat exchanger (70) is recovered to the heat source circuit (11) before the compression element (20) stops.

In the present embodiment, the refrigerant in the utilization heat exchanger (70) is recovered to the heat source circuit (11) before the compression element (20) stops. This allows the refrigerant in the utilization heat exchanger (70) to be collected in the component (e.g., the receiver (41)) of the heat source circuit (11).

[Feature (10) of Embodiment]

In the heat source unit (10) of the present embodiment, the compression element (20) includes a plurality of compressors (21, 22, 23). The heat source controller (14) drives any one of the plurality of compressors (21, 22, 23) in the first operation.

In the present embodiment, any one of the compressors (21, 22, 23) included in the compression element (20) is driven in the first operation. This can make power consumption required for driving the compression element (20) lower than that required for driving two or more of the compressors (21, 22, 23).

[Feature (11) of Embodiment] In the heat source unit (10) of the present embodiment, the refrigerant flowing through the refrigerant circuit (100) (the heat source circuit (11)) is carbon dioxide.

In the present embodiment, use of carbon dioxide as the refrigerant allows the refrigeration apparatus (1) including the heat source unit (10) to perform a refrigeration cycle in which the pressure of the refrigerant is equal to or greater than the critical pressure.

[Feature (12) of Embodiment]

The refrigeration apparatus (1) of the present embodiment includes the heat source unit (10) described above and the utilization unit (15) provided with the utilization circuit (16) having the utilization heat exchanger (70).

In the present embodiment, the pressure in the receiver (41) of the heat source unit (10) can be kept from becoming abnormal.

Other Embodiments

It has been described above that the heat source circuit (11) is configured to allow the suction port of the third compressor (23) to communicate with the liquid outlet of the receiver (41) in the first operation. However, the heat source circuit (11) is not limited to have such a configuration. For example, when the third compressor (23) has a suction port, an intermediate port, and a discharge port, the heat source circuit (11) may be configured to allow the intermediate port of the third compressor (23) to communicate with the liquid outlet of the receiver (41) in the first operation. The suction port communicates with a compression chamber (i.e., a low pressure compression chamber) of the third compressor (23) during a suction phase of the third compressor (23). The intermediate port communicates with the compression chamber (i.e., an intermediate pressure compression chamber) of the third compressor (23) during a compression phase of the third compressor (23). The discharge port communicates with the compression chamber (i.e., a high pressure compression chamber) of the third compressor (23) during a discharge phase of the third compressor (23). Alternatively, the heat source circuit (11) may be configured such that the suction port of the first compressor (21) and/or the suction port of the second compressor (22) communicates with the liquid outlet of the receiver (41) in the first operation. In this example, the heat source controller (14) may drive the first compressor (21), the second compressor (22), and the third compressor (23) in the first operation. When the first compressor (21) and/or the second compressor (22) has the suction port, the intermediate port, and the discharge port, the heat source circuit (11) may be configured to allow the intermediate port of the first compressor (21) and/or the intermediate port of the second compressor (22) to communicate with the liquid outlet of the receiver (41) in the first operation.

It has been described above that the third compressor (23) is driven and the first compressor (21) and the second compressor (22) are stopped in the first operation. However, the compressors are not limited to such a state. For example, the heat source controller (14) may drive the first compressor (21) (or the second compressor (22)) only, among the first, second, and third compressors (21, 22, 23), in the first operation. In this case, the heat source circuit (11) may be configured such that the suction port of the first compressor (21) (or the second compressor (22)) communicates with the gas outlet of the receiver (41) through the gas passage (P1), and the discharge port of the first compressor (21) (or the second compressor (22)) communicates with the gas end of the heat source heat exchanger (40) in the first operation.

The compression element (20) described above may have two or fewer compressors, or four or more compressors. The compression element (20) may include a plurality of compressors, or may be configured as a multiple stage compression mechanism provided in a single casing.

It has been described that the refrigeration apparatus (1) includes the utilization unit (15) constituting the indoor unit (15*a*) and the utilization unit (15) constituting the cold storage unit (15*b*). However, the refrigeration apparatus (1) is not limited to include these utilization units. For example, the refrigeration apparatus (1) may include a utilization unit (15) constituting a heating unit for heating the inside of a warm storage.

It has been described above that the refrigerant filling the refrigerant circuit (100) is carbon dioxide. However, the refrigerant is not limited to this example. The refrigerant filling the refrigerant circuit (100) may be a refrigerant other than carbon dioxide.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure.

INDUSTRIAL APPLICABILITY

As can be seen in the foregoing, the present disclosure is useful for a heat source unit and a refrigeration apparatus.

EXPLANATION OF REFERENCES

1 Refrigeration Apparatus
10 Heat Source Unit
11 Heat Source Circuit
12 Heat Source Fan
13 Cooling Fan
14 Heat Source Controller
15 Utilization Unit
16 Utilization Circuit
17 Utilization Fan
18 Utilization Controller
20 Compression Element
30 Switching Unit
40 Heat Source Heat Exchanger
41 Receiver
42 Cooling Heat Exchanger
43 Intercooler
44 Heat Source Expansion Valve
45 Cooling Expansion Valve
46 Venting Valve
70 Utilization Heat Exchanger
71 Utilization Expansion Valve
100 Refrigerant Circuit
200 Controller
RV Pressure Release Valve
P1 Gas Passage
P2 Connection Passage
V1 On-Off Valve

The invention claimed is:

1. A heat source unit of a refrigeration apparatus, the heat source unit comprising:

a heat source circuit having a compressor assembly, a heat source heat exchanger, and a receiver; and a heat source controller configured to determine, when the compressor assembly is in a stopped state, whether a pressure in the receiver exceeds a predetermined first pressure, and perform a first operation when the pressure in the receiver exceeds the predetermined first pressure, wherein the heat source controller allows an inlet of the compressor assembly to communicate with the receiver, and drives the compressor assembly in the first operation.

2. The heat source unit of claim 1, wherein the heat source circuit includes a gas passage that allows the inlet of the compressor assembly to communicate with the receiver, and an on-off valve provided in the gas passage, and the heat source controller opens the on-off valve in the first operation.

3. The heat source unit of claim 1, wherein a refrigerant that has been discharged from the compressor assembly is supplied to the heat source heat exchanger in the first operation.

4. The heat source unit of claim 3, wherein the heat source circuit includes a connection passage that allows the heat source heat exchanger to communicate with the receiver.

5. The heat source unit of claim 4, wherein the heat source circuit includes a heat source expansion valve provided in the connection passage, and the heat source controller controls the heat source expansion valve in the first operation so that the refrigerant that has flowed out of the heat source heat exchanger is decompressed by the heat source expansion valve and supplied to the receiver.

6. The heat source unit of claim 4, wherein the heat source circuit includes a heat source expansion valve provided in the connection passage, and the heat source controller fully closes the heat source expansion valve after the first operation ends.

7. The heat source unit of claim 1, wherein the heat source controller ends the first operation when the pressure in the receiver falls below a second pressure which is lower than the first pressure.

8. The heat source unit of claim 1, wherein the heat source circuit includes a pressure release valve configured to operate when the pressure in the receiver exceeds a predetermined operating pressure, and the first pressure is lower than the predetermined operating pressure.

9. The heat source unit of claim 1, wherein the heat source circuit is connected to a utilization circuit having a utilization heat exchanger to form a refrigerant circuit that performs a refrigeration cycle, and the heat source controller controls the refrigerant circuit so that a refrigerant in the utilization heat exchanger is recovered to the heat source circuit before the compressor assembly stops.

10. The heat source unit of claim 1, wherein the compressor assembly includes a plurality of compressors, and the heat source controller drives any one of the plurality of compressors in the first operation.

11. The heat source unit of claim 1, wherein a refrigerant flowing through the heat source circuit is carbon dioxide.

12. A refrigeration apparatus, comprising: the heat source unit of claim 1; and a utilization unit provided with a utilization circuit having a utilization heat exchanger.

13. The heat source unit of claim 2, wherein a refrigerant that has been discharged from the compressor assembly is supplied to the heat source heat exchanger in the first operation.

14. The heat source unit of claim 2, wherein the heat source controller ends the first operation when the pressure in the receiver falls below a second pressure which is lower than the first pressure.

15. The heat source unit of claim 3, wherein the heat source controller ends the first operation when the pressure in the receiver falls below a second pressure which is lower than the first pressure.

16. The heat source unit of claim 4, wherein the heat source controller ends the first operation when the pressure in the receiver falls below a second pressure which is lower than the first pressure.

17. The heat source unit of claim 5, wherein the heat source controller ends the first operation when the pressure in the receiver falls below a second pressure which is lower than the first pressure.

18. The heat source unit of claim 6, wherein the heat source controller ends the first operation when the pressure in the receiver falls below a second pressure which is lower than the first pressure.

* * * * *